US010184645B2

(12) United States Patent
Sonneman

(10) Patent No.: US 10,184,645 B2
(45) Date of Patent: Jan. 22, 2019

(54) CYLINDRICAL HOUSING FOR MODULAR LIGHTING SYSTEM

(71) Applicant: Contemporary Visions, LLC, Larchmont, NY (US)

(72) Inventor: Robert A. Sonneman, Mamaroneck, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 15/585,278

(22) Filed: May 3, 2017

(65) Prior Publication Data

US 2018/0128460 A1 May 10, 2018

Related U.S. Application Data

(63) Continuation-in-part of application No. 29/587,102, filed on Dec. 9, 2016, now Pat. No. Des. 793,000.

(60) Provisional application No. 62/419,505, filed on Nov. 9, 2016.

(51) Int. Cl.

| | |
|---|---|
| ***F21V 21/104*** | (2006.01) |
| ***F21S 8/06*** | (2006.01) |
| ***F21V 21/35*** | (2006.01) |
| ***F21V 21/14*** | (2006.01) |

(Continued)

(52) U.S. Cl.

CPC ..... *F21V 21/14* (2013.01); *F21S 8/046* (2013.01); *F21S 8/063* (2013.01); *F21S 8/065* (2013.01); *F21V 21/104* (2013.01); *F21V 21/112* (2013.01); *F21V 21/35* (2013.01)

(58) Field of Classification Search

None

See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |
| D222,748 | S | 12/1971 | Strianese |

(Continued)

FOREIGN PATENT DOCUMENTS

| | | | |
|---|---|---|---|
| CN | 200 986 123 | Y | 12/2007 |
| CN | 205261379 | U | 5/2016 |

(Continued)

OTHER PUBLICATIONS

Non-Final Office Action dated Dec. 6, 2017 issued in corresponding U.S. Appl. No. 15/446,302.

(Continued)

*Primary Examiner* — Alan Cariaso

(74) *Attorney, Agent, or Firm* — Gottlieb, Rackman & Reisman, P.C.

(57) ABSTRACT

A modular lighting system that includes a pendant that is hung from and gets power from a power bar. The pendant can include a pendant body that is attached directly to and depends from the power bar. The pendant can be provided with one light source or two light sources that are directed in opposite directions. In another version, the pendant is attached to the power bar by a hanger and has connectors allowing the pendant to rotate about a horizontal axis. The hanger can include a member attached to the power bar and configured to allow two rods and the pendant depending from the rods to rotate about a vertical axis.

21 Claims, 31 Drawing Sheets

(51) Int. Cl.
*F21S 8/04* (2006.01)
*F21V 21/112* (2006.01)

(56) References Cited

U.S. PATENT DOCUMENTS

| | | | | |
|---|---|---|---|---|
| 3,716,031 | A | 2/1973 | Rowbury | |
| 3,748,463 | A | 7/1973 | Trassinelli | |
| 4,723,747 | A | 2/1988 | Karp | |
| 4,758,935 | A | 7/1988 | Frassati et al. | |
| 4,763,870 | A | 8/1988 | Wodlinger | |
| D301,304 | S | 5/1989 | Will | |
| D317,058 | S | 5/1991 | Sonneman | |
| 5,025,355 | A | 6/1991 | Harwood | |
| D320,465 | S | 10/1991 | Sonneman | |
| 5,065,295 | A | 11/1991 | De La Haye et al. | |
| 5,105,349 | A | 4/1992 | Falls | |
| D360,046 | S | 7/1995 | Sugiura | |
| 5,440,469 | A | 8/1995 | Gomes | |
| 5,455,754 | A | 10/1995 | Hoffner | |
| 5,584,576 | A | 12/1996 | Wei Hong | |
| D392,407 | S | 3/1998 | Johnson et al. | |
| 5,833,358 | A * | 11/1998 | Patik | H01R 25/147 362/391 |
| 6,135,615 | A * | 10/2000 | Lee | H01R 25/147 362/147 |
| 6,179,442 | B1 | 1/2001 | Schurle | |
| 6,241,369 | B1 | 6/2001 | Mackiewicz | |
| 6,244,733 | B1 | 6/2001 | Fong et al. | |
| 6,341,979 | B1 | 1/2002 | Yamamoto | |
| 6,409,524 | B1 | 6/2002 | Miller et al. | |
| 6,489,748 | B1 | 12/2002 | Okamura | |
| 6,659,623 | B2 | 12/2003 | Friend | |
| 6,769,790 | B2 | 8/2004 | Hermann | |
| D507,374 | S | 7/2005 | Chen | |
| 7,172,332 | B2 | 2/2007 | Mobarak et al. | |
| 7,246,935 | B2 | 7/2007 | Benghozi et al. | |
| 7,397,384 | B1 | 7/2008 | Mackenzie, IV | |
| 7,503,778 | B2 | 3/2009 | Lehman et al. | |
| 7,507,005 | B1 | 3/2009 | Mier-Langner | |
| 7,520,762 | B2 | 4/2009 | Lehman et al. | |
| 7,520,763 | B1 | 4/2009 | Buse | |
| 7,527,406 | B2 | 5/2009 | Kwon | |
| D595,884 | S | 7/2009 | Liao | |
| 7,563,000 | B2 | 7/2009 | Gierveld | |
| 7,571,736 | B1 | 8/2009 | Chu | |
| 7,654,834 | B1 | 2/2010 | Imier-Langner et al. | |
| D611,169 | S | 3/2010 | Harder | |
| D620,168 | S | 7/2010 | Sabernig | |
| 7,794,132 | B2 | 9/2010 | Cunius | |
| 7,798,824 | B2 | 9/2010 | Fong | |
| 7,806,913 | B2 | 10/2010 | Fanger | |
| D629,954 | S | 12/2010 | Compton | |
| D632,423 | S | 2/2011 | Canfield | |
| 7,955,125 | B1 | 6/2011 | Petrillo | |
| D648,470 | S | 11/2011 | Rains | |
| D649,692 | S | 11/2011 | Trzesniowski | |
| 8,061,865 | B2 | 11/2011 | Piepgras et al. | |
| D671,670 | S | 11/2012 | Sonneman | |
| 8,398,276 | B2 | 3/2013 | Pearson et al. | |
| D680,673 | S | 4/2013 | Levine | |
| D689,221 | S | 9/2013 | Isaac | |
| 8,523,378 | B2 | 9/2013 | Schulzman | |
| 8,584,412 | B2 | 11/2013 | Frecska et al. | |
| 8,616,871 | B2 | 12/2013 | Galomb | |
| 8,733,710 | B1 | 5/2014 | Suazo | |
| 8,794,804 | B2 | 8/2014 | Verfuerth | |
| 8,814,383 | B2 | 8/2014 | Bizzotto et al. | |
| 8,840,319 | B2 | 9/2014 | Hogue | |
| 8,967,573 | B2 | 3/2015 | Hemmer | |
| D739,070 | S | 9/2015 | Wilson | |
| 9,136,659 | B2 | 9/2015 | Fishman et al. | |
| D747,636 | S | 1/2016 | Maher | |
| 9,387,268 | B2 | 7/2016 | Farren | |
| D765,296 | S | 8/2016 | Wei | |
| 9,464,772 | B2 | 10/2016 | O'Brien et al. | |
| 9,472,912 | B2 | 10/2016 | Schirmeier | |
| D772,467 | S | 11/2016 | Sonneman | |
| D772,475 | S | 11/2016 | Sonneman | |
| D773,099 | S | 11/2016 | Sonneman | |
| D773,101 | S | 11/2016 | Sonneman | |
| D773,715 | S | 12/2016 | Sonneman | |
| D773,719 | S | 12/2016 | Sonneman | |
| D773,725 | S | 12/2016 | Sonneman | |
| D775,397 | S | 12/2016 | Sonneman | |
| D779,113 | S | 2/2017 | Sonneman | |
| D779,437 | S | 2/2017 | Sonneman | |
| D779,712 | S | 2/2017 | Sonneman | |
| D779,713 | S | 2/2017 | Sonneman | |
| D779,714 | S | 2/2017 | Sonneman | |
| D779,715 | S | 2/2017 | Sonneman | |
| D782,990 | S | 4/2017 | Sonneman | |
| 9,739,460 | B2 | 8/2017 | Haubach | |
| 9,765,954 | B2 | 9/2017 | Zaderej et al. | |
| 2003/0031018 | A1 | 2/2003 | Bray et al. | |
| 2003/0103347 | A1 | 6/2003 | Friend | |
| 2004/0005798 | A1 | 1/2004 | Lin | |
| 2004/0160767 | A1 | 8/2004 | Mobarak et al. | |
| 2005/0207173 | A1 | 9/2005 | Benghozi | |
| 2007/0053209 | A1 | 3/2007 | Uhler et al. | |
| 2007/0115694 | A1 | 5/2007 | Mobarak et al. | |
| 2007/0247845 | A1 | 10/2007 | Udo | |
| 2008/0190043 | A1 | 8/2008 | Beckmann | |
| 2009/0051292 | A1 | 2/2009 | Noh | |
| 2009/0123994 | A1 | 5/2009 | Lafaye et al. | |
| 2010/0271834 | A1 | 10/2010 | Muessli | |
| 2010/0271847 | A1 | 10/2010 | Mobarak et al. | |
| 2012/0257388 | A1 | 10/2012 | Bracher et al. | |
| 2014/0226315 | A1 | 8/2014 | Nicieja et al. | |
| 2015/0198311 | A1 | 7/2015 | O'Brien et al. | |
| 2015/0316238 | A1 | 11/2015 | Guilmette | |
| 2015/0338037 | A1 | 11/2015 | Wang et al. | |
| 2016/0033098 | A1 | 2/2016 | Bergman et al. | |
| 2017/0198892 | A1 | 7/2017 | Sonneman | |

FOREIGN PATENT DOCUMENTS

| | | | |
|---|---|---|---|
| DE | 8708815 | U1 | 11/1987 |
| DE | 4414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 0734108 | A2 | 9/1996 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |
| WO | 2016/150564 | A2 | 9/2016 |

OTHER PUBLICATIONS

Non-Final Office Action dated Dec. 22, 2017 issued in corresponding U.S. Appl. No. 15/584,171.

Final Office Action dated Dec. 29, 2017 issued in corresponding U.S. Appl. No. 15/287,897.

Non-Final Office Action dated Jan. 12, 2018 issued in corresponding U.S. Appl. No. 15/801,855.

Non-Final Office Action dated Jan. 11, 2018 issued in corresponding U.S. Appl. No. 15/801,893.

Non-Final Office Action dated Jan. 11, 2018 issued in corresponding U.S. Appl. No. 15/808,109.

EPO, Extended European Search Report dated Jan. 3, 2018 issued in corresponding European Patent Application No. 17200563.9.

EPO, Extended European Search Report dated Jan. 5, 2018 issued in corresponding European Patent Application No. 17200550.6.

Non-Final Office Action dated Jan. 17, 2018 issued in corresponding U.S. Appl. No. 15/427,217.

(56) References Cited

OTHER PUBLICATIONS

USPTO, Non-Final Office Action dated Jan. 13, 2017 issued in corresponding U.S. Appl. No. 15/251,369.
USPTO, Non-Office Action dated Mar. 3, 2017 issued in corresponding U.S. Appl. No. 15/255,289.
USPTO, Non-Final Office Action dated Mar. 7, 2017 issued in corresponding U.S. Appl. No. 15/287,897.
USPTO, Non-Final Office Action dated Feb. 10, 2017 issued in corresponding U.S. Appl. No. 15/286,977.
USPTO, Non-Final Office Action dated Mar. 1, 2017 issued in corresponding U.S. Appl. No. 15/378,207.
USPTO, Non-Final Office Action dated Dec. 22, 2016 issued in corresponding U.S. Appl. No. 15/197,919.
USPTO, Final Office Action dated Apr. 5, 2017 issued in corresponding U.S. Appl. No. 15/197,919.
EPO, Extended European Search Report dated Jun. 26, 2017 issued in corresponding European Patent Application No. 171506868.8.
USPTO, Non-Final Office Action dated Aug. 18, 2017 issued in corresponding U.S. Appl. No. 15/584,171.
USPTO, Non-Final Office Action dated Sep. 27, 2017 issued in corresponding U.S. Appl. No. 15/407,085.
USPTO, Final Office Action dated Jun. 6, 2017 issued in corresponding U.S. Appl. No. 15/251,369.
USPTO, Non-Final Office Action dated Sep. 7, 2017 issued in corresponding U.S. Appl. No. 15/287,897.
EPO, Extended European Search Report dated Mar. 27, 2018 issued in corresponding European Patent Application No. 17200553.0 filed Nov. 8, 2017.
EPO, Extended European Search Report dated Mar. 28, 2018 issued in corresponding European Patent Application No. 17200535.7 filed Nov. 8, 2017.
EPO, Extended European Search Report dated Mar. 28, 2018 issued in corresponding European Patent Application No. 17200541.5 filed Nov. 8, 2017.
EPO, Partial European Search Report dated Apr. 24, 2018 issued in corresponding European Patent Application No. 17200544.9 filed Nov. 8, 2017.
EPO, Extended European Search Report dated Aug. 7, 2018 issued in corresponding European Patent Application No. 17200544.9 filed Nov. 8, 2017.
CIPO, First Office Action dated Sep. 25, 2018 issued in corresponding Canadian Patent Application No. 2,984,651 filed Nov. 2, 2017.
CIPO, First Office Action dated Sep. 25, 2018 issued in corresponding Canadian Patent Application No. 2,984,672 filed Nov. 2, 2017.

* cited by examiner

CYLINDRICAL HOUSING FOR MODULAR LIGHTING SYSTEM

CROSS-REFERENCE TO RELATED APPLICATIONS

This application is a continuation in part of U.S. patent application Ser. No. 15/407,085, filed Jan. 16, 2017, which claims benefit of U.S. Provisional Patent Application No. 62/419,505, filed Nov. 9, 2016, and is a continuation in part of U.S. Design patent application No. 29/587,102, filed Dec. 9, 2016, the contents of which are incorporated herein by reference in their entirety.

FIELD OF THE INVENTION

This invention pertains generally to a modular lighting system having components, including canopies, hangers, power bars and pendants (e.g., LED bulbs), that can be assembled to form multi-level lights of various sizes, shapes and configurations, and more specifically to a modular lighting system that includes a cylindrical housing that can be used to attach various lighting fixtures directly to a power bar of the modular lighting system.

BACKGROUND OF THE INVENTION

Designing a lighting system for a space has always been a challenge because the lighting system has to meet utilitarian, technical and aesthetic needs. Thus, any such endeavor is successful only if technical, architectural and artistic skills are combined.

Several different types of ceiling lights are presently available, including surface mounted lights, recessed lights and hanging lights. The present invention pertains to hanging lights.

SUMMARY OF THE INVENTION

In general, the present invention is directed to a modular lighting system that is configured to provide light in a space. The modular lighting system can include canopies that are connectable to a power source, a plurality of power bars, a plurality of hangers, including a first set of hangers that support the power bars from the canopy and a second set of hangers that support a plurality of pendants. The hangers and the power bars cooperate to provide electric power to the pendants from the canopy.

Preferably, each power bar includes two bar segments facing each other and being made of a non-conductive material. Conductive rails are provided on the inner surface of each power bar segment. The hanger is configured to form an interference fit with the bar segments.

In one embodiment, the power bars are straight or linear. In another embodiment, the power bars are circular or have some other curvilinear shape.

The power bars preferably extend horizontally, however different power bars are disposed at different heights and are supported from one or more canopies or straight from a ceiling by hangers of various configurations or cables.

Preferably, at least one of the canopies is connected to a line voltage and transformer is used to step down the line voltage to a lower voltage such as 24 VAC, which is then distributed to the pendants through the hangers and the power bars.

The pendants include light emitting elements such as LEDs, electronic circuitry for driving the LEDs, and are preferably shaped for heat dissipation. Since the LEDs have a long life, they are not replaceable, but instead the whole pendant is replaced as needed.

These various elements are combined in many different ways resulting in a virtually infinite number of configurations. One configuration may include several power bars disposed in a vertical plane. In another class of configurations, several bars extend at different angles in one plane and are joined at a common point. Another configuration may include a combination of the previously mentioned configurations. Yet another configuration may include several power bars disposed at different heights or tiers with some of the power bars being perpendicular to other power bars.

The present disclosure is generally directed to a housing that can attach lights directly to one of the power bars.

In one embodiment, a pendant is provided that includes a center hub having first surface, a second surface spaced from the first surface, a channel extending from the second surface toward the first surface and delimited by a first internal wall and a second internal wall that is spaced from the first internal wall and electrical clips arranged within the channel, the channel configured to extend over the first rail and the second rail of the power bar with the electrical clips configured to form an interference fit and an electrical connection within the rails of the power bar a pendant body attached to the first surface of the center hub and a light source arranged within the pendant body and receiving power through said electrical clips and generating light.

The pendant can include two pins that extend from the first surface of the center hub and two openings in the pendant body with the pendant body being attached to the center hub by coupling the pendant body and the center hub with the pins entering said openings and twisting said pendant body and said center hub with respect to each other. The pins provide electrical current to said light source. The center hub and the pendant body have matching cross-sections. For instance, the center hub and the pendant body are cylindrical.

In one embodiment, a second pendant body, which is substantially identical to said first pendant body, is provided, with the pendant bodies having light sources pointing in different direction.

The pendant can further comprise a cover that is configured to contact a side of the power bar opposite the electrical clips of the center hub and be attached to the center hub to secure the center hub to the power bar and concealing the channel of the center hub.

The center hub can include a first tab that has a hole extending therethrough and a second tab that is spaced from the first tab that has a second hole extending therethrough. The cover can include a first opening extending therethrough and a second opening extending therethrough that is spaced from the first opening. The openings can be configured to be aligned with the first hole and the second hole of the first tab and the second tab, respectively. A first fastener can extend through the first hole and the first tab and a second fastener can extend through the second hole and the second tab to fix the cover to the center hub. The openings of the pendant body can be arcuate.

The pendant can further comprise a cover assembly that includes a lens that is mountable to the pendant body to disperse light from the light source and a ring to secure the lens to the pendant body. In an embodiment, a support member is mountable to the pendant body and a covering is spaced from the cover assembly.

In another embodiment, the present disclosure is directed to a pendant body including a first surface and a second surface that is spaced from the first surface, a first channel extending from the first surface toward the second surface and a second channel that is spaced from the first channel, extending from the first surface toward the second surface, a first connector disposed in the first channel and a second connector disposed in the second channel. Each of the first connector and the second connector are configured to receive a respective end of one of the rods and a light source is disposed in the pendant body and generates light when receiving current from the power bar through the rods and the first connector and the second connector are configured to rotate within the first channel and the second channel, respectively, to allow the pendant body to rotate about a horizontal axis with respect to the rods while remaining connected to the rods. The first channel and the second channel can be parallel to each other, and the first channel and the second channel can be sized to receive a portion of the rods when said pendant body is disposed at an angle of about plus or minus 90°. A lens can be arranged within an opening in the second surface, covering the light source.

In another embodiment, a pendant is provided with a hanger having a power bar engaging member selectively engaging the power bar and two vertical rods, each rod being electrically connected to a respective rail of the power bar; and a pendant body having first and second connectors. Each said connector is configured to receive a respective end of one of said vertical rods. The pendant body further includes a light source generating light when receiving current from the power bar through the rods and said connectors.

The connectors are arranged and constructed to rotate within the pendant body to allow the pendant body to rotate about a horizontal axis with respect to the rods while remaining connected to the rods.

In one embodiment, the power bar engaging member is configured to allow said rods to rotate about a vertical axis with respect to the power bar.

In one embodiment, the power bar engaging member is formed with two horizontal channels with a separating wall sized and shaped to engage the power bar with the two segments disposed in said channels. The bar engaging member further includes electrical clips arranged to form an interference fit and an electrical connection with the rails within the power bar, the rods being electrically connected to the rails of the power bar through said clips.

The hanger includes a lower body selectively attached to the power bar engaging member with the power bar disposed within the channels. The rods depend on said lower body.

In another embodiment, the present invention is directed to a modular lighting system having a power bar that includes a first rail and a second rail that is horizontally spaced from the first rail and receives power from a power source. The modular lighting system comprises an assembly including a first housing having a first surface, a second surface, a first channel extending from the second surface toward the first surface, a second channel that is spaced from the first channel extending from the second surface toward the first surface, a central wall extending from the housing toward the second surface, separating the first channel and the second channel, the first channel and the second channel configured to extend over the first rail and the second rail of the power bar with the central channel extending between and engaging the first rail and the second rail of the power bar and a second housing including a first surface having a shaft extending therefrom and a second surface having a first rod and a second rod extending therefrom, the rod configured to extend between the rails of the power bar and be contactable with the first housing. The second housing can include a first conducting surface and a second conductive surface that is arranged on the first surface thereof.

The first housing can include a hole in the first surface thereof and an axle configured to be arranged in the hole and engage the shaft of the second housing. A disk can be configured to be attached to the axle and rotatable to move the first rod and the second rod about a vertical axis with respect to the power bar.

DETAILED DESCRIPTION OF EMBODIMENTS OF THE INVENTION

With reference now to the drawings, and in particular FIGS. 1-11B, embodiments of elements of modular lighting systems of the present invention will be described.

In general, each modular lighting system of the present disclosure includes one or more canopies, a plurality of hangers, a plurality of power bars and a plurality of pendants. The hangers can include (1) parallel hangers and/or (2) perpendicular hangers. Parallel hangers are used to support one power bar beneath another in parallel. Perpendicular hangers are used to support one power bar from another that extend perpendicular to each other. Hangers can support power bars from canopies, power bars from ceilings without a power connection and pendants. As will be described in detail below, each hanger must be able to interface with a power bar at at least one end. In addition, some systems may include connectors.

Unless otherwise noted, all the hangers and all power bars consist of two interconnected elements.

Figure 1:
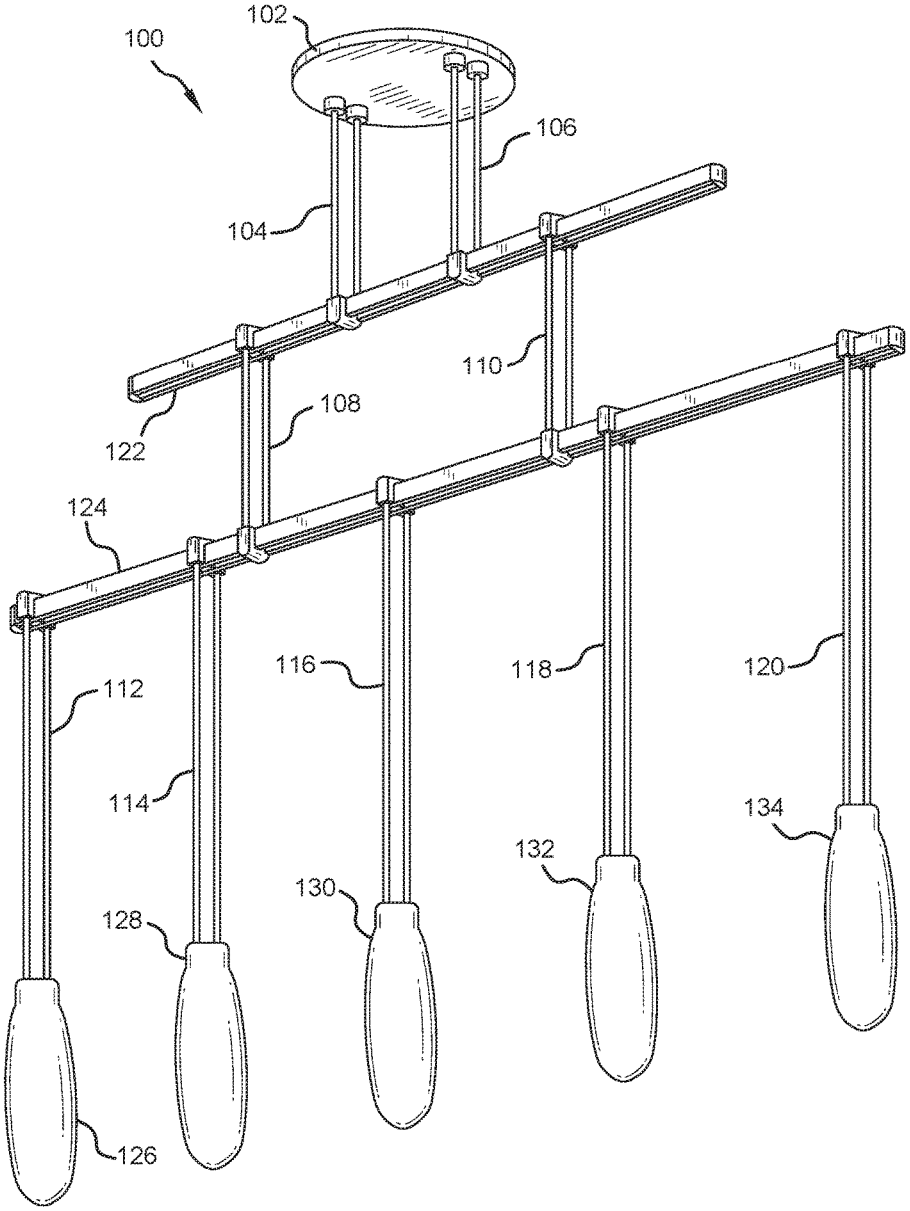
FIG. 1 is a perspective view of an embodiment of a modular lighting system.

FIG. 1 shows an embodiment of a modular lighting system 100 that includes a canopy 102 that supports the modular lighting system 100 from a ceiling or other similar architectural member in a conventional manner. In this case, the canopy 102 also provides power to the modular lighting system 100. Other, lighting systems may have several canopies that support such systems and only some or only one canopy may also provide power. Here, the canopy 102 includes a conventional power supply connected to standard AC lines that provide power to light-emitting diode (LED) tubes in pendants 126, 128, 130, 132, 134 as discussed below. The power supply is hidden.

Two power feed hangers 104, 106 extend downwardly from the canopy 102. In an embodiment, each hanger discussed hereinafter consists of two solid bars or rods. In another embodiment (not shown), the power feed hangers 104, 106 are replaced by multi-strand twisted steel cables.

In FIG. 1, the power feed hangers 104, 106 are used to support a power bar 122. Two additional power feed hangers 108, 110 are interconnected with the power bar 122 and used to support a second power bar 124.

Pendant hangers 112, 114, 116, 118, 120 are used to support a plurality of pendants 126, 128, 130, 132, 134. The pendants 126, 128, 130, 132, 134 preferably include LED bulbs that run on 24 VAC.

Preferably, one of the power feed hangers 106, includes two hanger segments that are connected to a transformer disposed within the canopy 102. In an embodiment, power from the power feed hanger 106 flows through the first power bar 122, the hanger 110, the second power bar 124 and the hangers 112, 114, 116, 118, 120 to the pendants, 126, 128, 130, 132, 134, respectively. The transformer steps down the line voltage from a standard power line to 24 VAC for the pendants 126, 128, 130, 132, 134. The other power feed hanger 104 may be electrically floating. Thus, in this embodiment, all of the power bars 122, 124 carry power, but only some of the hangers 104, 106, 108, 110, 112, 114, 116, 118, 120 carry power.

Figure 2:
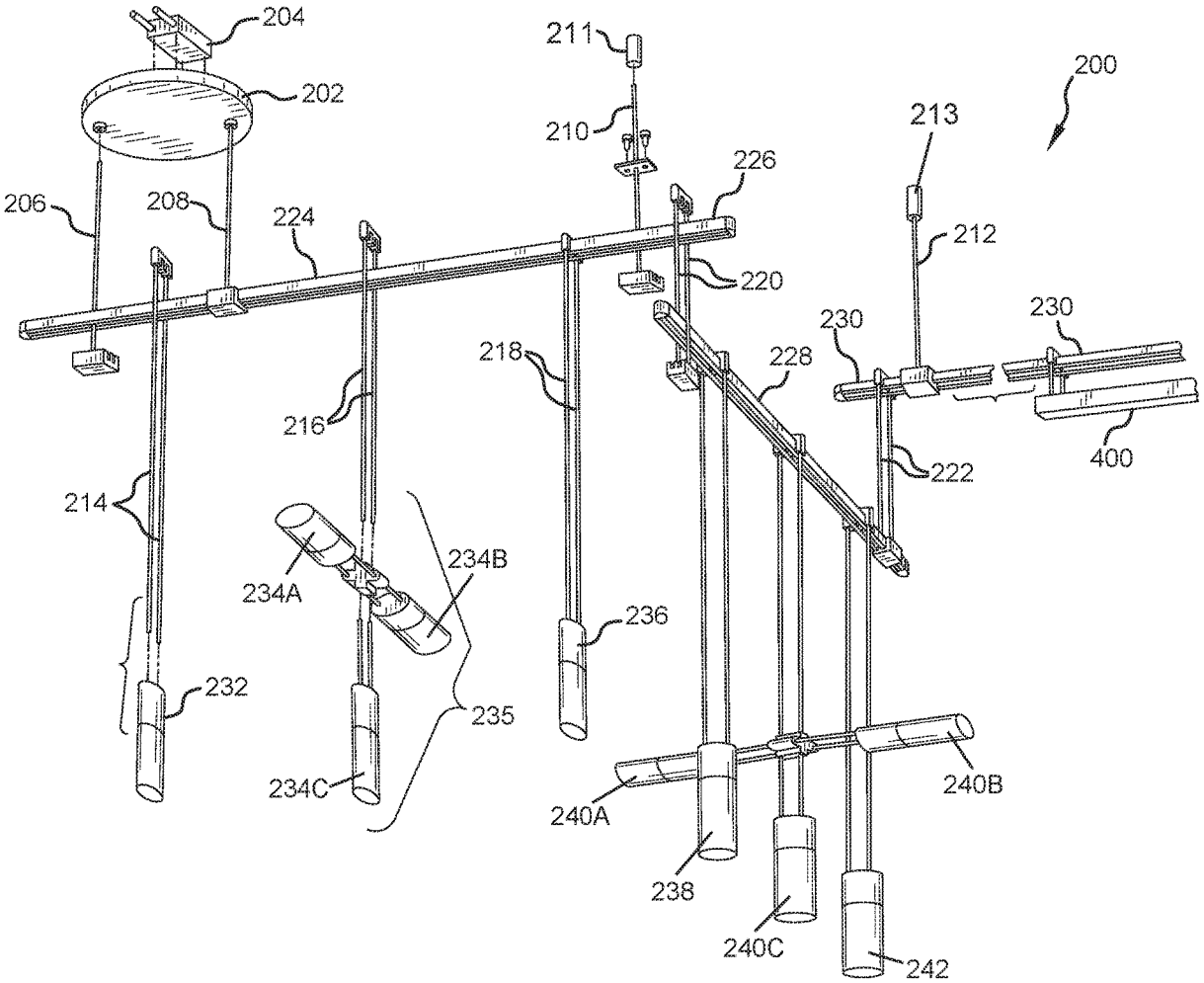
FIG. 2 is a perspective view of another embodiment of a modular lighting system.

FIG. 2 shows an embodiment of another modular lighting system 200. This system 200 includes a canopy 202 with a transformer 204. Attached to the canopy 202 by two hangers 206, 208 is a first power bar 224. As opposed to the hangers 104, 106, 108, 110, 112, 114, 116, 118, 120 of FIG. 1, these hangers 206, 208 have a single extended element, such as a rod. Each of the hangers 206, 208 provide power to one of the elements of the first power bar 224. However, because the first power bar 224 is not centered below the canopy 202, but extends in one direction away therefrom, another hanger 210, which may be referred to as a ceiling hanger, is used to support a distal end 226 of the first power bar 224. At its top, the hanger 210 is attached to a sleeve 211 that is secured to the ceiling in a conventional manner.

Hangers 214, 216, 218 are used to attach respective pendants 232, 234A, 234B, 234C, 236 from the first power bar 224 with one of the hangers 216 being used to support a cluster of pendants 235.

The modular lighting system 200 includes a second power bar 228 that is supported at one end by a hanger 220 that extends near the distal end 226 of the first power bar 224. The hanger 220 also provides power to the second power bar 228. A third power bar 230 is supported from the ceiling by ceiling hangers 212 that is attached to a sleeve 213 (only one such ceiling hanger and sleeve is being shown in FIG. 2 for the sake of clarity). A hanger 222 extends from the third power bar 230 to support the second end of the second bar 228 and provides power from the transformer 204 through the hanger 222 to a plurality of pendants 238, 240A, 240B, 240C, 242. Each of the power bars 224, 228, 230 can be used to hang pendants of various sizes and shapes and arranged in different configurations as desired. For example, as shown in FIG. 2, a linear light bar 400 can be disposed below the third power bar 230 and is configured to direct light downward.

FIGS. 3A-3K show details of an embodiment of a generic power bar 300. Unless otherwise noted, all of the power bars discussed previously and subsequently have the same configuration. The power bar 300 is merely a representative power bar of those described herein. In FIGS. 3A-3K, the power bar 300 is shown as being straight. However, the power bar 300 can be circular ellipsoid or another geometric shape. The power bar 300 includes two identical longitudinal segments, or rails 302, 304, that include inner surfaces that face each other.

Figure 3A:
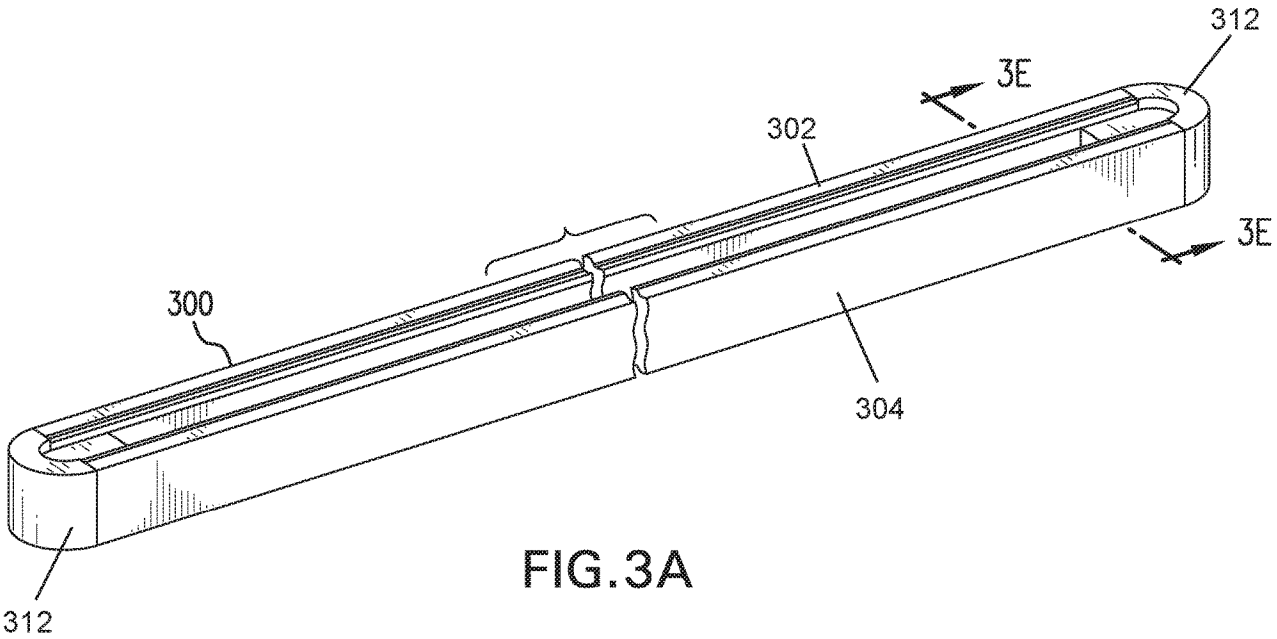
FIGS. 3A-3K are various views showing features of a power bar that can be used in the modular lighting system of FIG. 1 or FIG. 2.
Figure 3B:
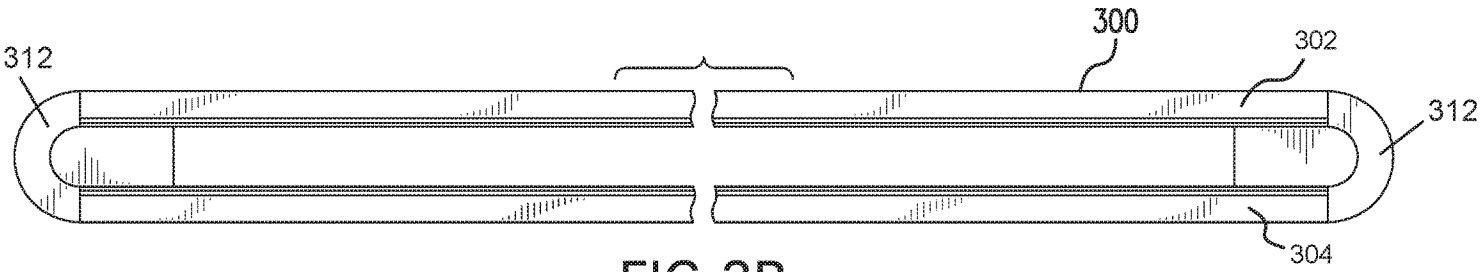
Figure 3C:
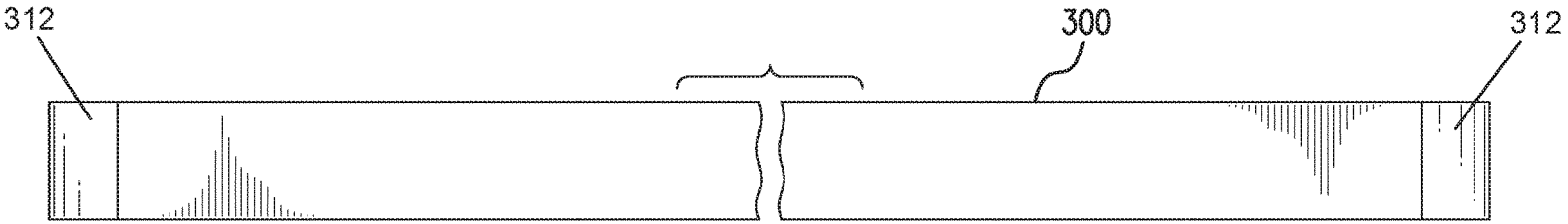
Figure 3E:
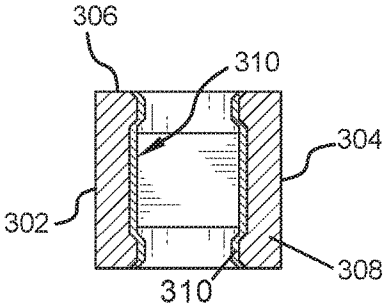
Figure 3D:
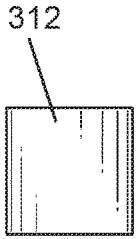
Figure 3F:
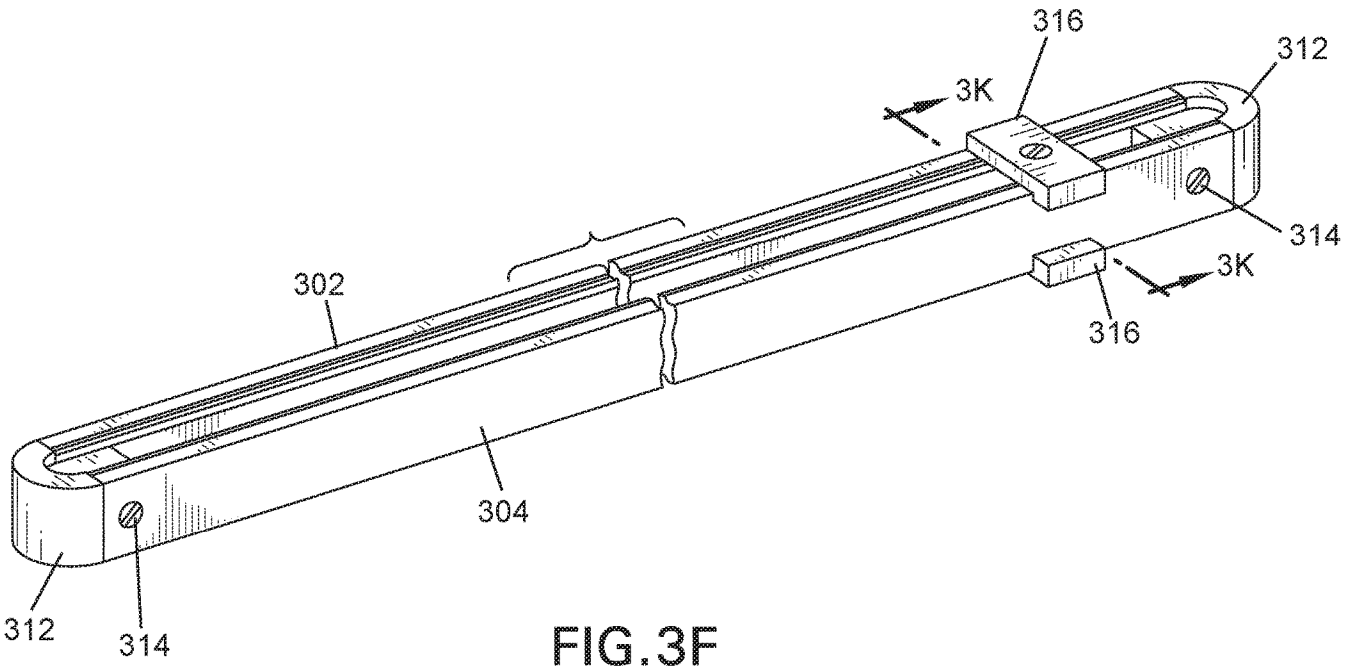
Figure 3G:
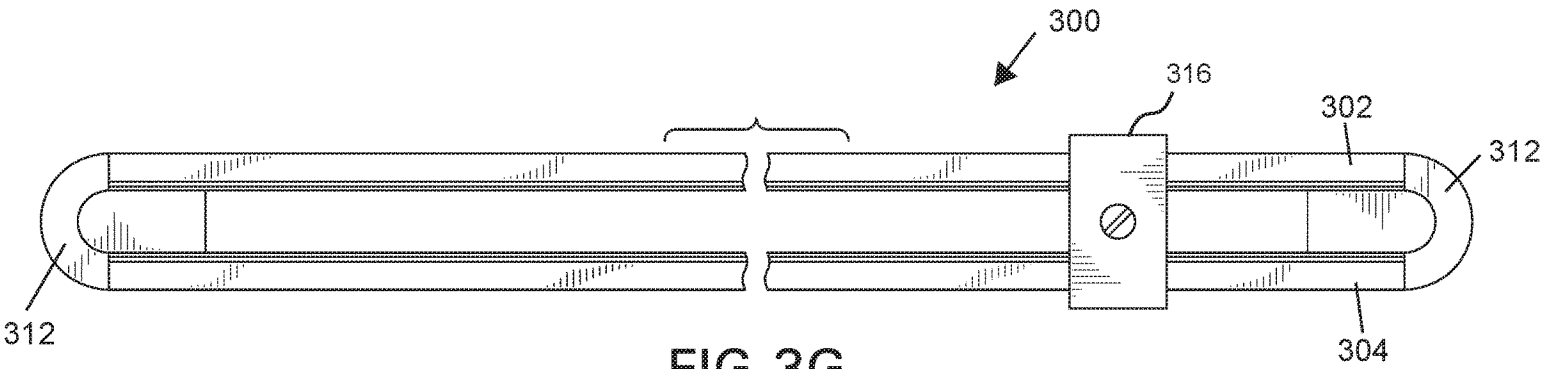
Figure 3H:
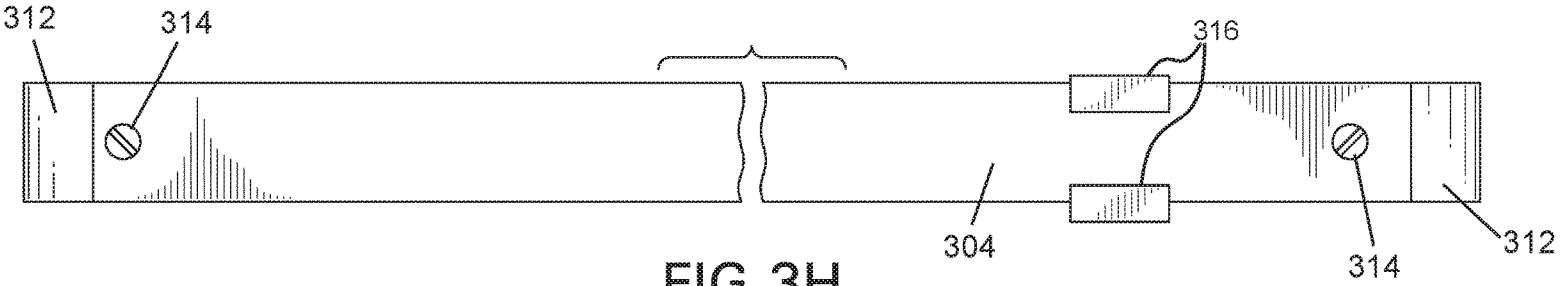
Figure 3K:
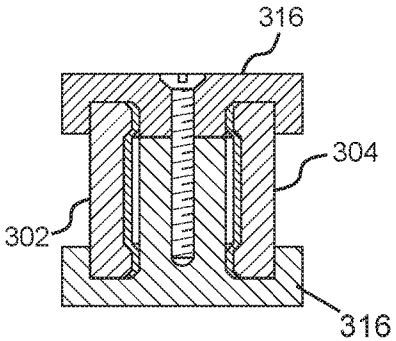
Figure 3J:
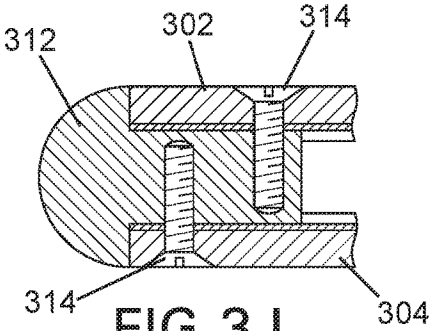
Figure 3I:
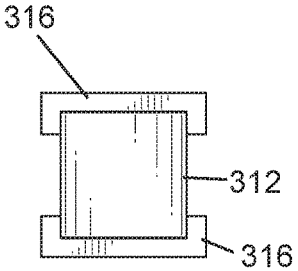

A cross-sectional view of the power bar 300 is seen in FIG. 3E. Each rail 302, 304 includes a C-shaped main body 306, 308, respectively, made of a non-conductive material, such as a plastic material that is light weight, but strong so that it can support various pendants, other bars, etc. and channels 310 that are made of a light weight conductive material such as aluminum and embedded into the inside surface of each rail 302, 304. Preferably, each rail 302, 304 includes a rectangular channel. The rails 302, 304 are joined together at each end by an end connector 312. The connectors 312 are attached to the rails 302, 304 by conventional means, such as screws 314, by an adhesive or other means.

Preferably, the two rails 302, 304 have inner surfaces that are spaced at a nominal distance throughout the length of the power bar 300. The power bar 300 is made in standard lengths ranging from to 12 to 48 inches. As shown, for example, in FIGS. 3H to 3K, for very long power bars, for example in excess of 24 inches, a spacer 316 is placed between the rails 302, 304. The spacer 316 may be held in place by screws or other means.

FIGS. 4A-4G show details of parallel hanger, such as hanger 110 from FIG. 1. The hanger 110 includes two vertical segments 111A, 111B. At the top and the bottom ends, the two segments 111A, 111B are imbedded in identical W-shaped bases 113, which are shown in more detail in FIGS. 4B-4G.

The base 113 forms two channels 115, 117 with a wall 113C separating the two channels 115, 117. Two metallic springs or clips 119, 121 extend outwardly from the base 113 into the channels 115, 117. One of the clips 119 is electrically attached to the first segment 111A within the base 113, and the other clip 121 is connected to the second segment 111B. Preferably, the base 113 is made of a non-conductive material and is overmolded to cover portions of the clips 119, 121 and segments 111A, 111B. In one embodiment, two bases 113 form a single, unitary structure. In another embodiment, at least the top base 113 is made of two sections 113A, 113B that snap together forming an interference fit therebetween.

Figure 4A:
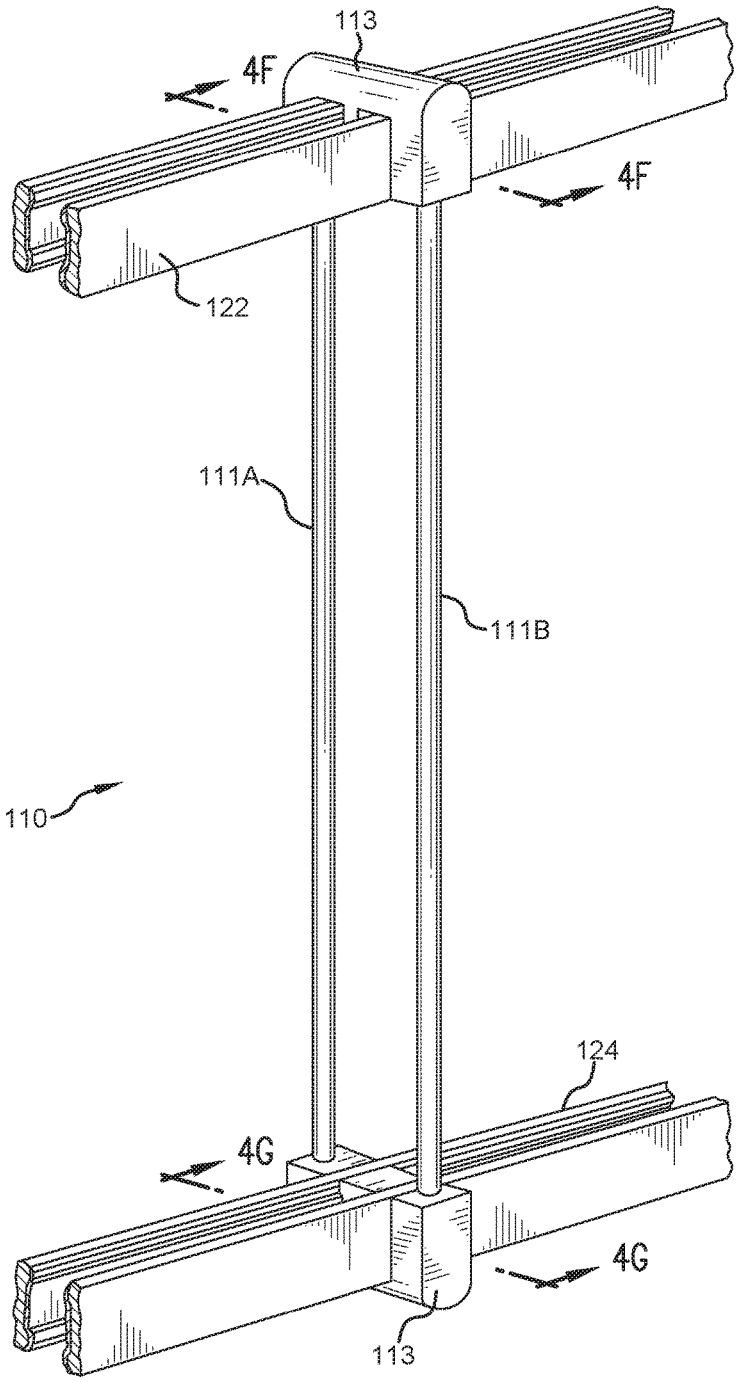
FIGS. 4A-4J are various views showing features of hangers used in the modular lighting system of FIG. 1 or FIG. 2.
Figure 4C:
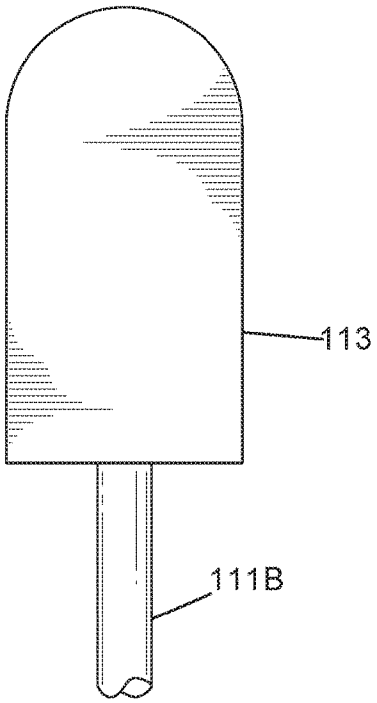
Figure 4B:
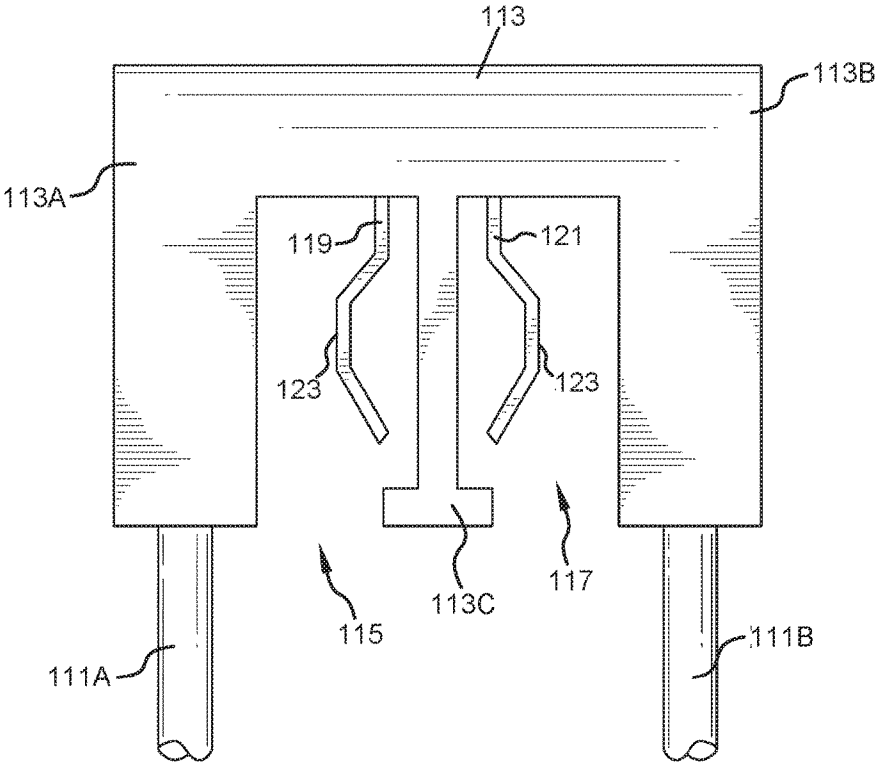
Figure 4D:
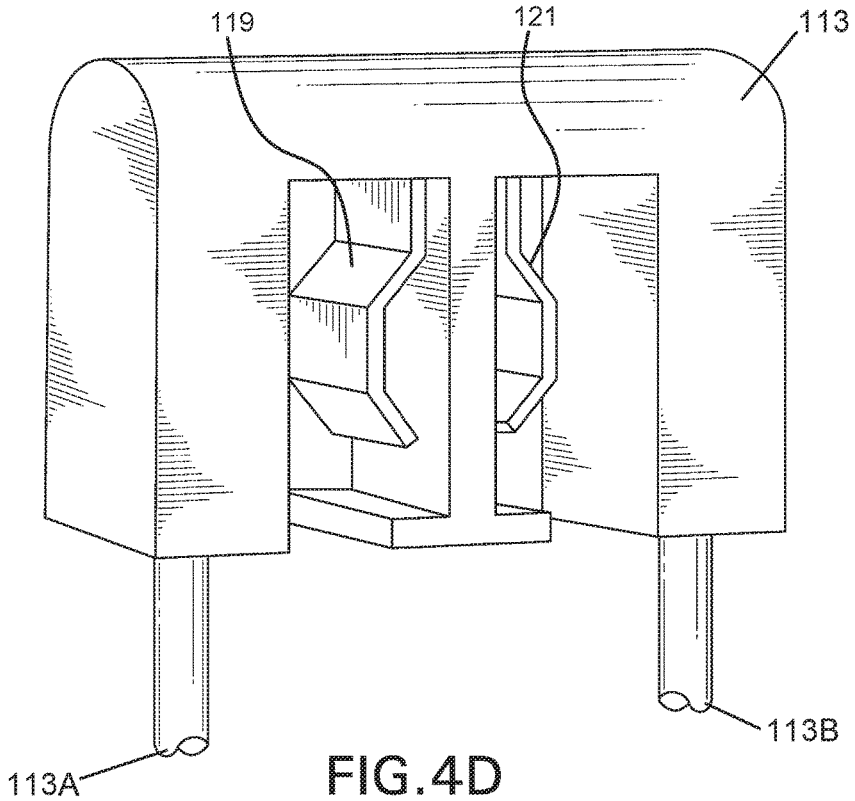
Figure 4E:
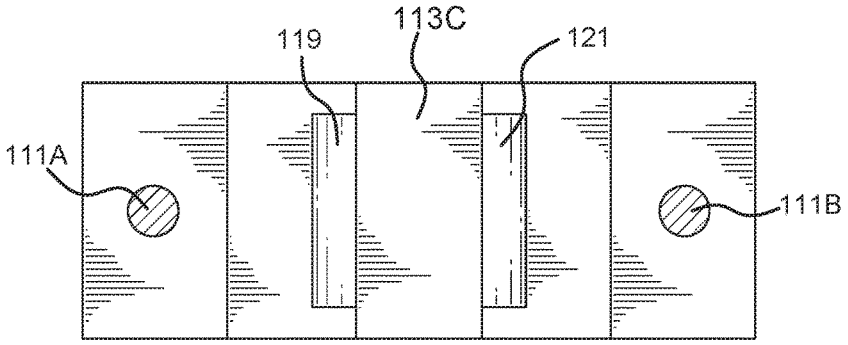
Figure 4F:
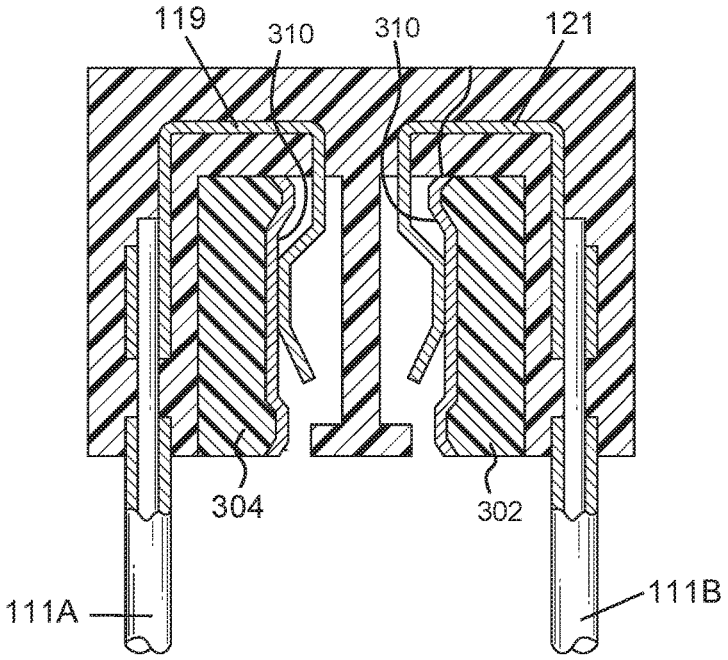
Figure 4G:
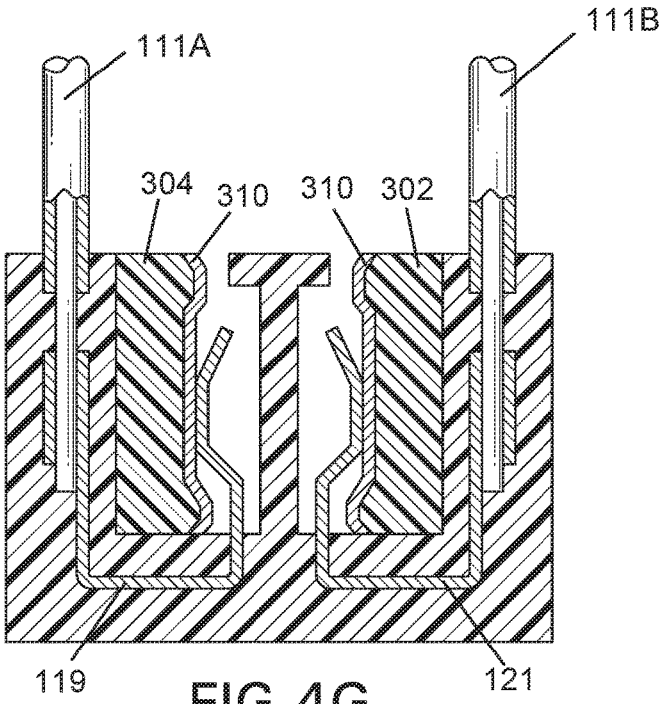

As can be seen in FIGS. 4F and 4G, the bases 113 are sized and shaped so that they fit over and engage the rails of a power bar. Here, for example, the bases 113 engage the rails 302, 304 of the generic power bar 300. Importantly, the clips 119, 121 are sized and shaped so that they engage the rails. The clips 119, 121 have a flat section 123 (see FIG. 4B) sized and shaped to snap into the channels 306, 308 of the rails 302, 304, respectively. In this manner not only do the clips 119, 121 provide a solid electrical contact with the rails 302, 304, but they also stabilize the hangers on the power bars (as shown in FIG. 4A, power bars 122, 124) and ensure that the lower power bar (as shown in FIG. 4A, for example, power bar 124) remains stiff and does move around in use. The clips may be made from beryllium copper.

The clips 119, 121 need not be connected electrically to the hanger segments. However, in other situations, for example, in the configuration shown in FIG. 2, the hangers 220 can provide an electrical connection to the power bars 228 and 230.

The hanger segments 111A, 111B are provided in various lengths as required to obtain the various systems described above, and they are preferably made in the shape of rods of a stiff, but somewhat springy material having shape memory such as a phosphor/bronze alloy. Preferably, except where an electrical contact is required, the rods are covered or painted with a thin electrically insulating material.

In an embodiment, a power bar, for example, power bar 300, can be connected to the housing 113 by separating the two segments 111A, 111B, passing a first power bar and a second power bar between the segments 111A, 111B, then lowering or raising the power bars toward the respective bases 113 and then snapping the bases 113 onto the power bars into the configurations shown in FIGS. 4F and 4G.

Figure 4H:
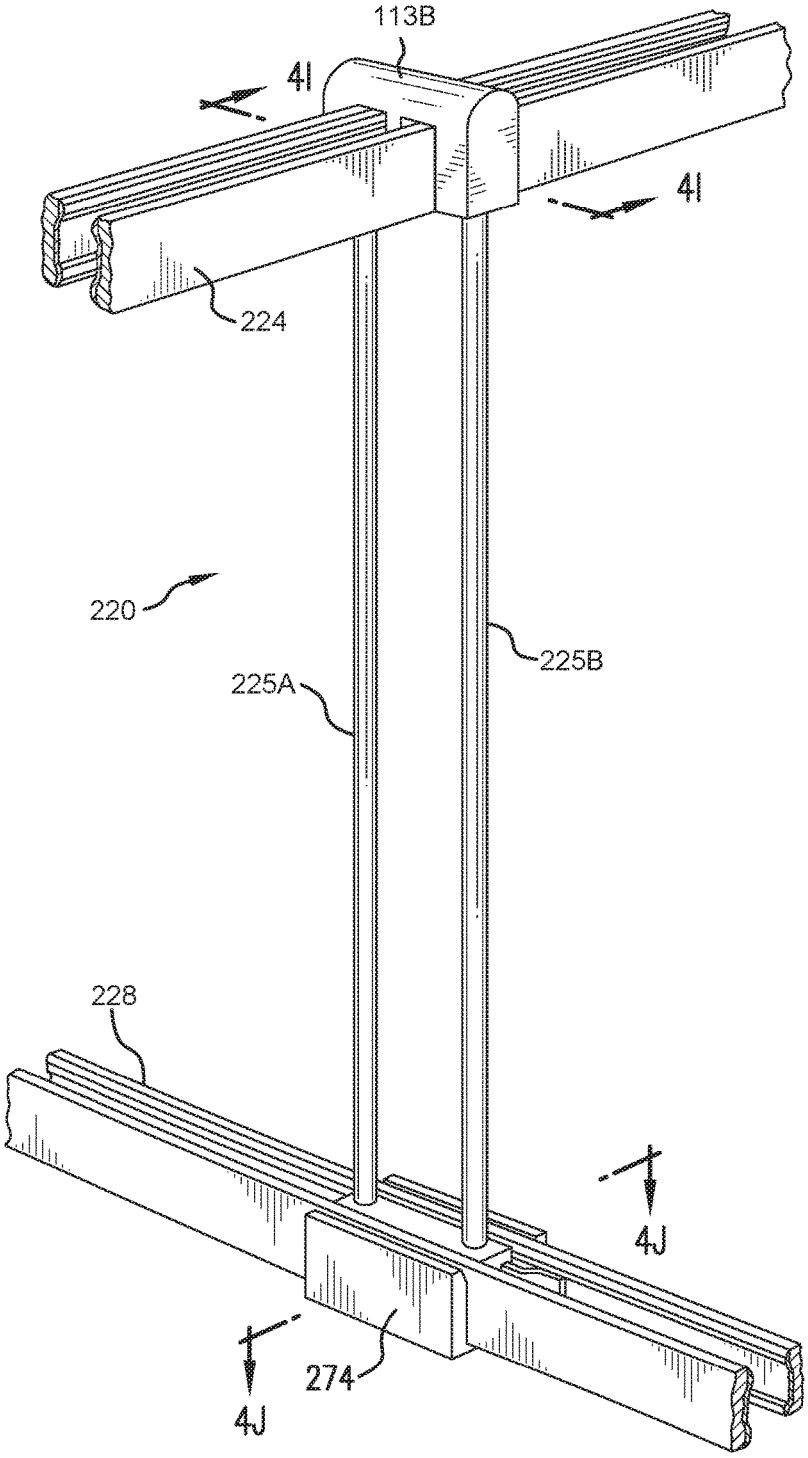
Figure 4I:
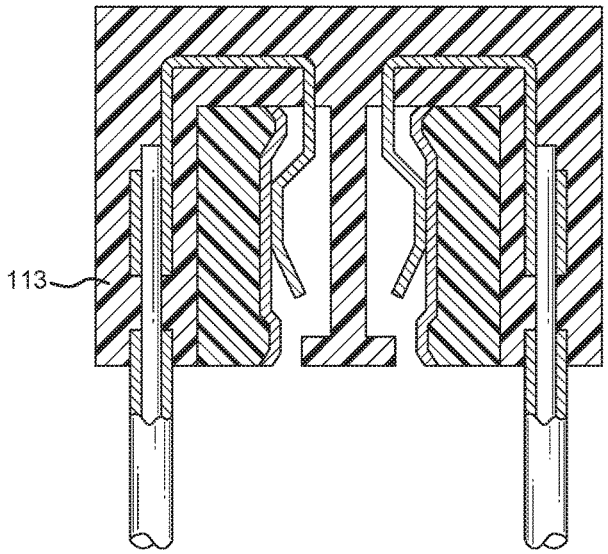
Figure 4J:
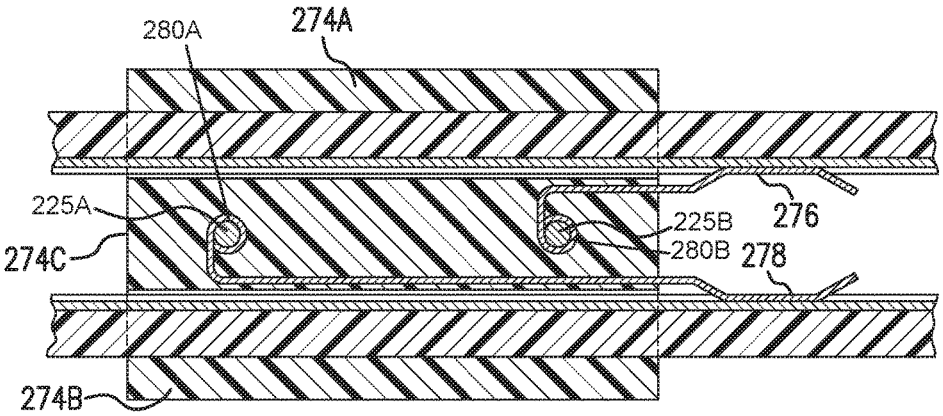

As discussed above, and illustrated in more detail below, in some instances, the power bars extend perpendicularly to each other. For example, in FIG. 2, the first power bar 224 and the second power bar 226 are perpendicular to each other. These power bars 224, 226 are interconnected using a hanger 220 that is shown in FIG. 4H. This hanger 220 has two segments 225A, 225B and a base 113B similar to the base 113 in FIGS. 4A-4G. However, at the bottom, the hanger 224 has a different base 274. This base 274 is formed with two side wings 274A, 274B and a center wall 274C. Clips 276, 278 are provided on the center wall 274C and are connected electrically with the segments 225A, 225B, respectively, as shown in FIG. 4J. The center wall 274C is made with two holes 280A, 280B with the lower ends of the segments 225A, 225B extending into the holes 280A, 280B and secured to the base 274. The base 274 is sized and shaped to engage and support a power bar, for example, power bar 228, with the hanger segments 225A, 225B providing power to the power bar 228. The base 113B engages the segments of the power bar 224 in the manner discussed above.

In the embodiments of FIGS. 1-4J pendants are attached to power bars through hangers. In the present invention, several different lights are connected directly to a power bar and no hangers are required.

Figure 5A:
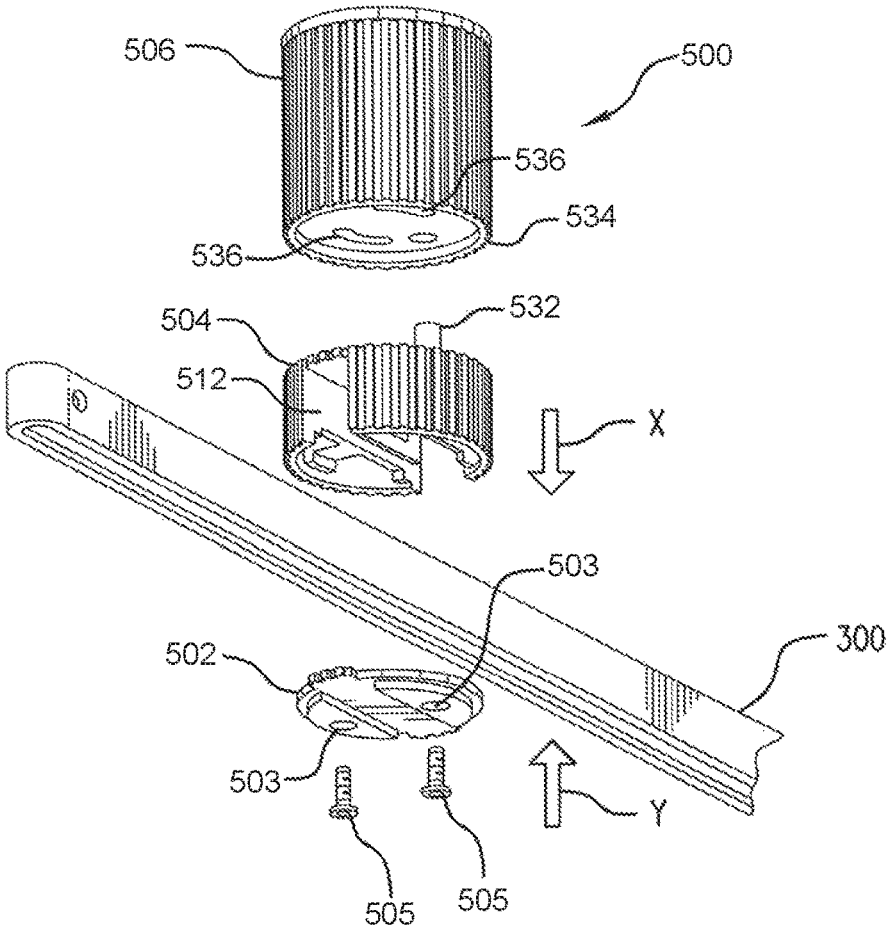
FIGS. 5A-5E are various views showing features of an embodiment of a spot light of the present invention that is configured to be directly on a power bar.
Figure 5B:
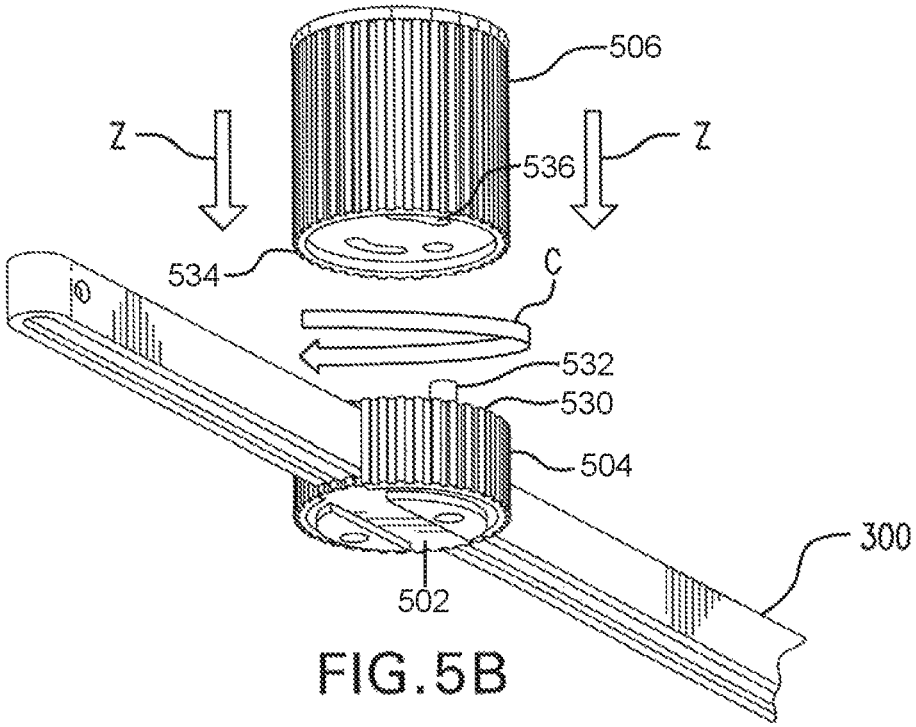
Figure 5C:
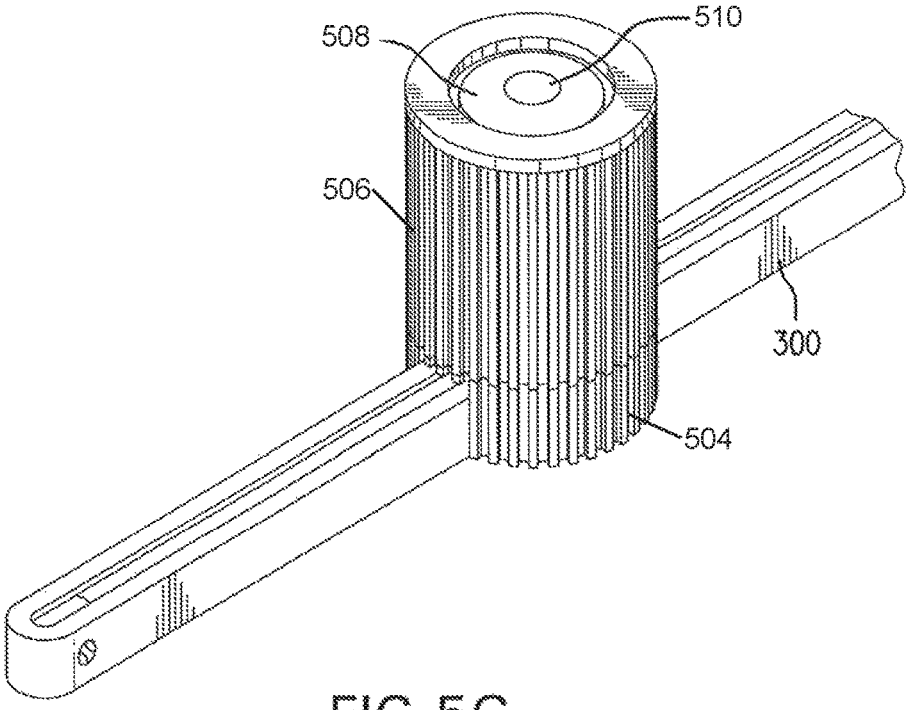

FIGS. 5A-5E show details of a spot light 500 that is attached to a standard power bar, such as the generic power bar 300 shown in FIGS. 3A-3K. The spot light 500 includes a cap 502, a center hub 504 and a spot head 506. As can be seen in FIG. 5C, the spot head 506 includes a flat top surface 508, which may be transparent or translucent and covering a light source 510, such as an LED.

Figure 5D:
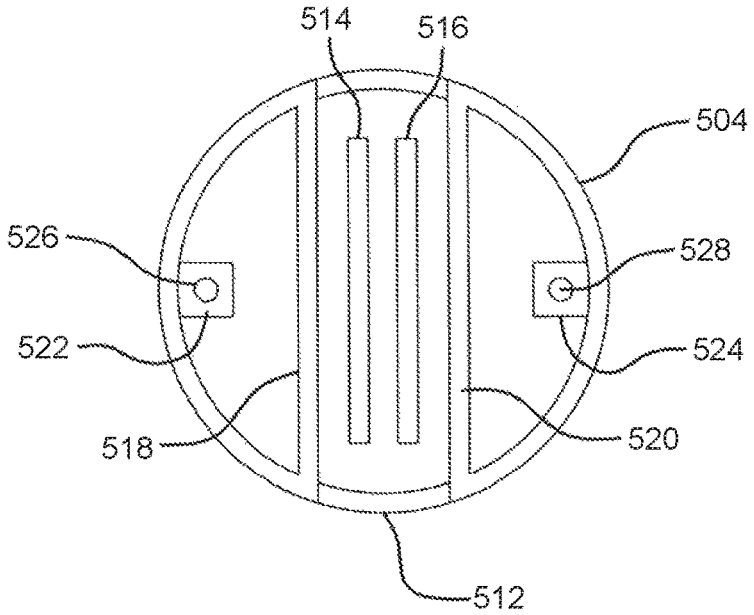
Figure 5E:
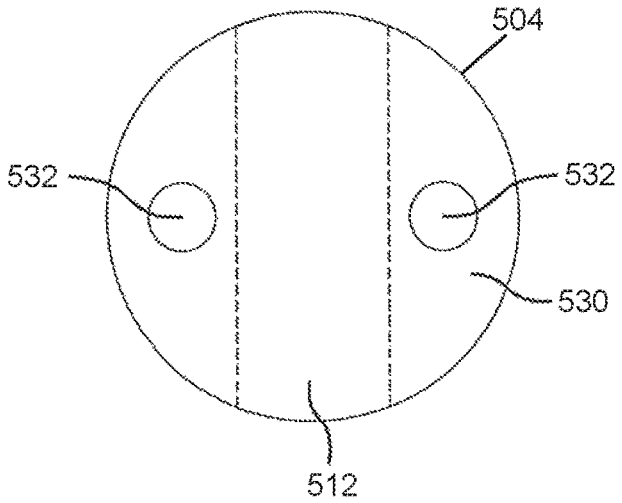

The center hub 504 and the cap 502 together form a housing that can be used to mount the spot heads 506 or other kinds of lights as discussed below. The hub 504 includes a channel 512. Inside the channel 512, as can be seen in FIG. 5D, clips 514, 516 are provided, which are similar to the clips 119, 121 of the hanger 110 so that when the hub 504 is snapped onto the power bar 300, the power bar 300 fits snugly into the channel 512 and the clips 514, 516 form an interference fit with the rails 302, 304 of the power bar 300. The hub 504 can be solid or can be hollow with two internal walls 518, 520 defining the channel 512. Two tabs 522, 524 with threaded holes 526, 528, respectively, may be included on the hub 504 as shown, for example, in FIG. 5D.

The cap 502 may have a disc shape with a diameter equal to the diameter of the hub 504 and shaped to cover the channel 512. The cap 502 includes two countersunk holes 503 and is attached to the hub 504 by two screws 505 that are arranged in the threaded holes 526, 528 of the tabs 522, 524, respectively, of the center hub 504.

The hub 504 further includes on its top surface 530 two bayonet-type pins 532. The spot head 506 is formed with a bottom surface 534 that has two arcuate openings 536. The openings 536 are sized and shaped to the pins 532.

Typically, the hub 504 is first snapped onto power bar 300 (arrow X) and the cover 502 is then attached to the hub 504 (arrow Y) with the screws 505. Next, the spot head 506 is mounted on the hub 504 by lowering the head 504 (arrow Z) until the pins 532 enter the openings 536 and then twisting the head 506 in the direction C (see FIG. 5B) thereby engaging the head 506 to hub 504. Power to the head 506 is provided through the pins 532. The pins 532 are connected by hidden internal connectors within the central hub 504 to the clips 514, 516 and hence to the rails 302, 304 of the power bar 300.

In FIGS. 5A-5C, the spot light 500 is mounted on the power bar 300 so that the LED 510 is pointed upward. Alternatively, the spot light 500 can be turned around so that its LED 510 is pointing downward.

Figure 6A:
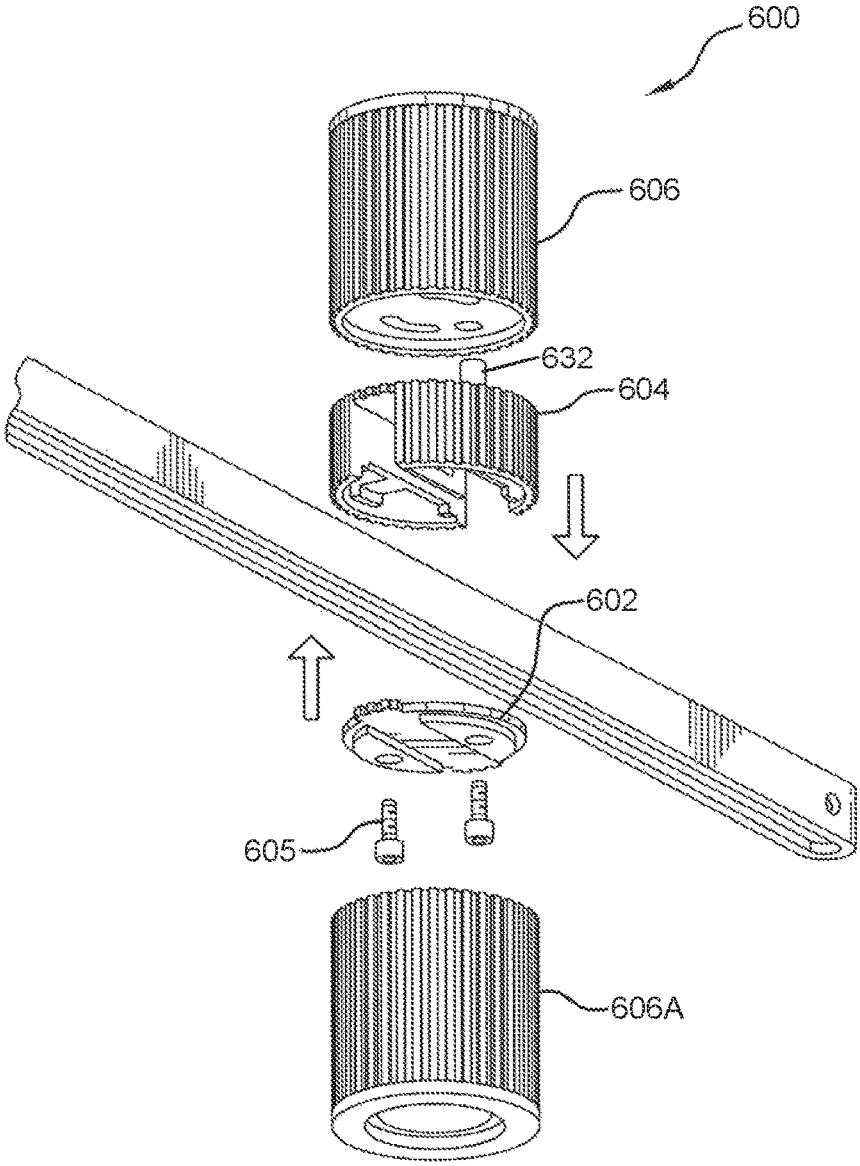
FIGS. 6A-6C are various views showing features of another embodiment of a spot light of the present invention that is configured to be mountable directly on a power bar.
Figure 6B:
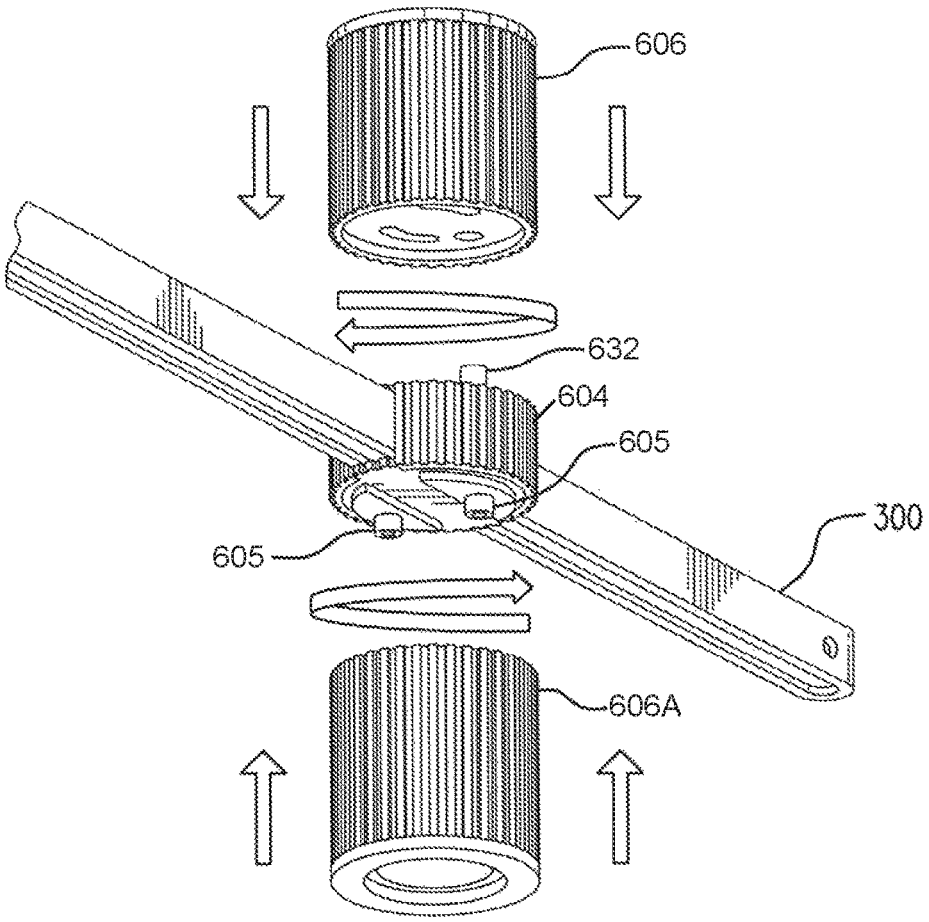
Figure 6C:
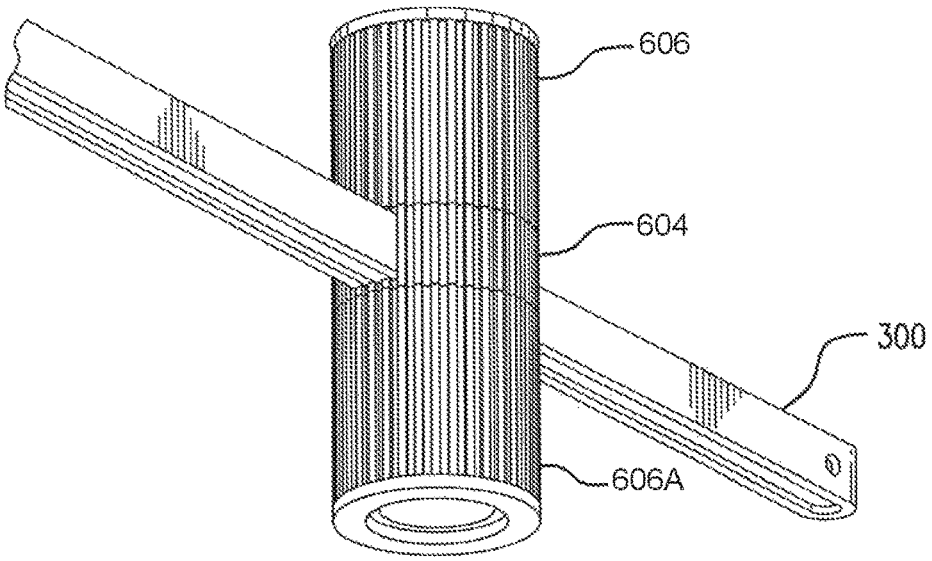

FIGS. 6A-6C show orthogonal views of a double headed spot light 600. This spot light 600 includes a cap 602, hub 604 and spot head 606 identical to the cap 502, hub 504 and spot head 506 of FIGS. 5A-5E (like reference numbers to those in FIGS. 5A-5E are used in FIGS. 6A-6C) and an additional spot head 606A identical to the head 506 described above and the opposing head 606 in FIGS. 6A-6C. For this double headed configuration, the cap 502 is reversed and threaded pins 605 are used to attach the cap 602 to the hub 604 as seen in FIG. 6A. The heads 606, 606A are then attached to pins 632 (only one pin is shown, but like FIGS. 5A-5E, two pins 632 extend from the hub 604) by twisting the first head 606 and the second head 606A in opposite directions, as seen in FIG. 6B. The final assembled and mounted spot light 600 is shown in FIG. 6B.

Figure 7A:
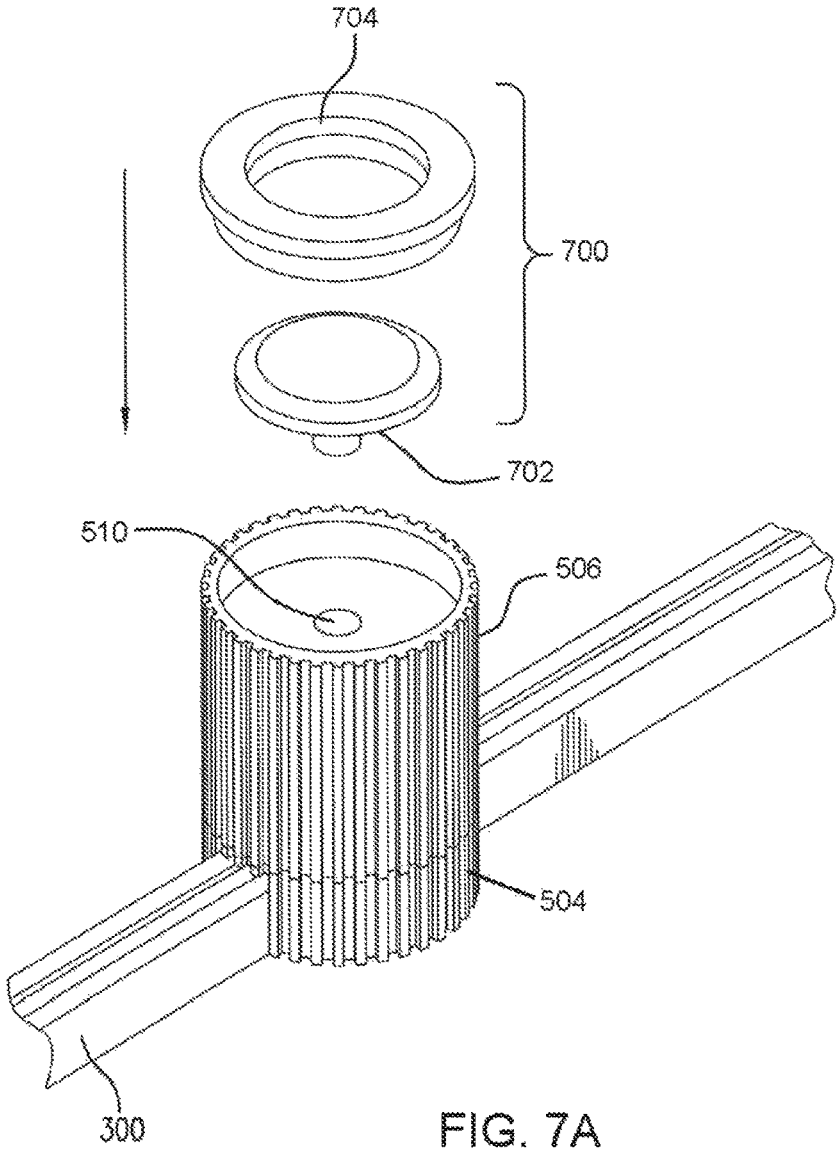
FIGS. 7A and 7B are various views showing features of another embodiment of a spot light of the present invention that is configured to be mountable directly on a power bar.
Figure 7B:
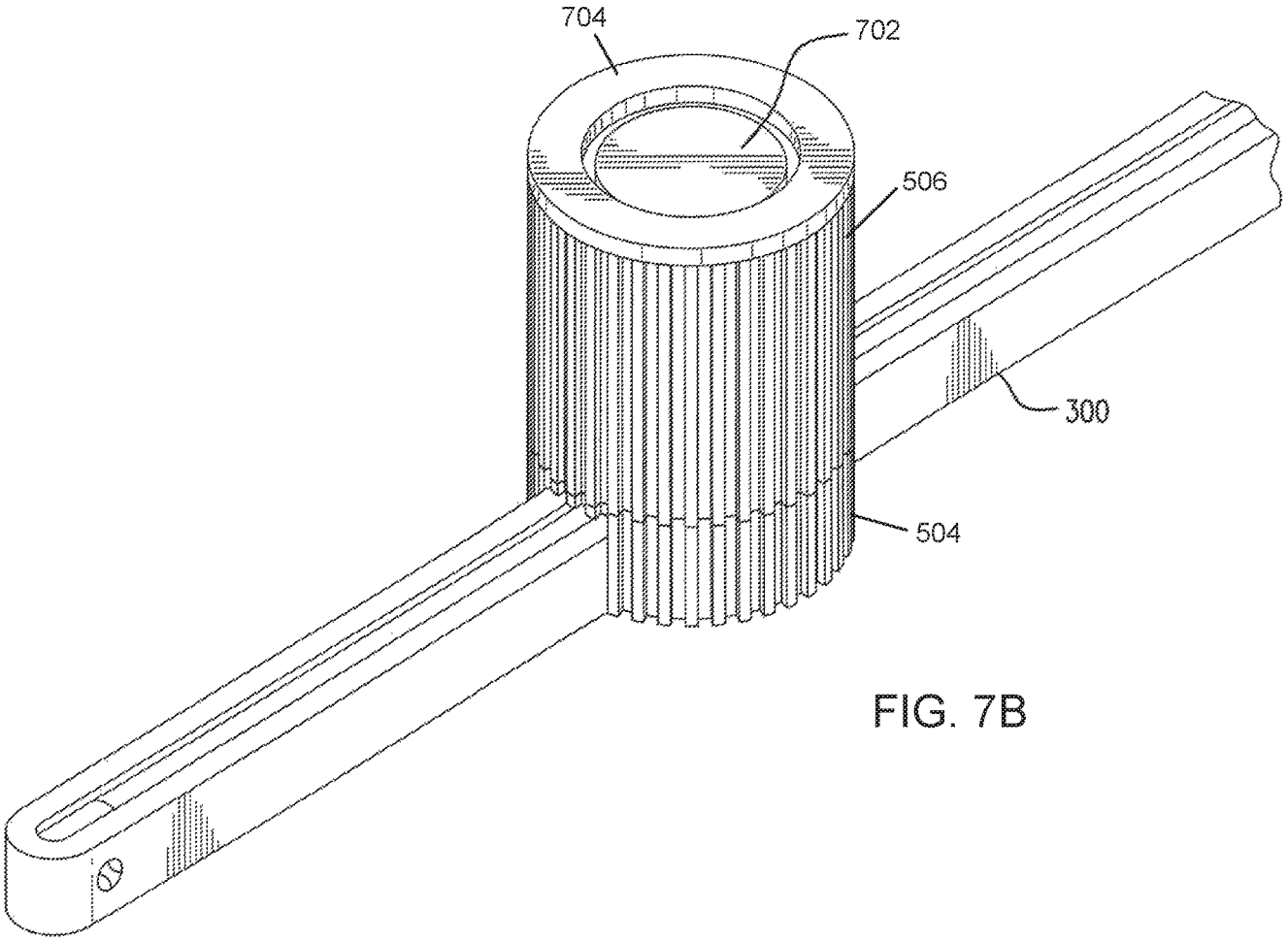

The hub 504, 604 and the spot head 506, 606 as described above and shown in FIGS. 5A-5E and 6A-6C can be used for various kinds of pendants by adding suitable accessories. In FIGS. 7A and 7B, a transparent cover 700 that includes a lens 702 is mounted to the head 506 by a ring 704. The lens 702 is positioned to disperse or focus light from the LED 510 as desired.

Figure 8A:
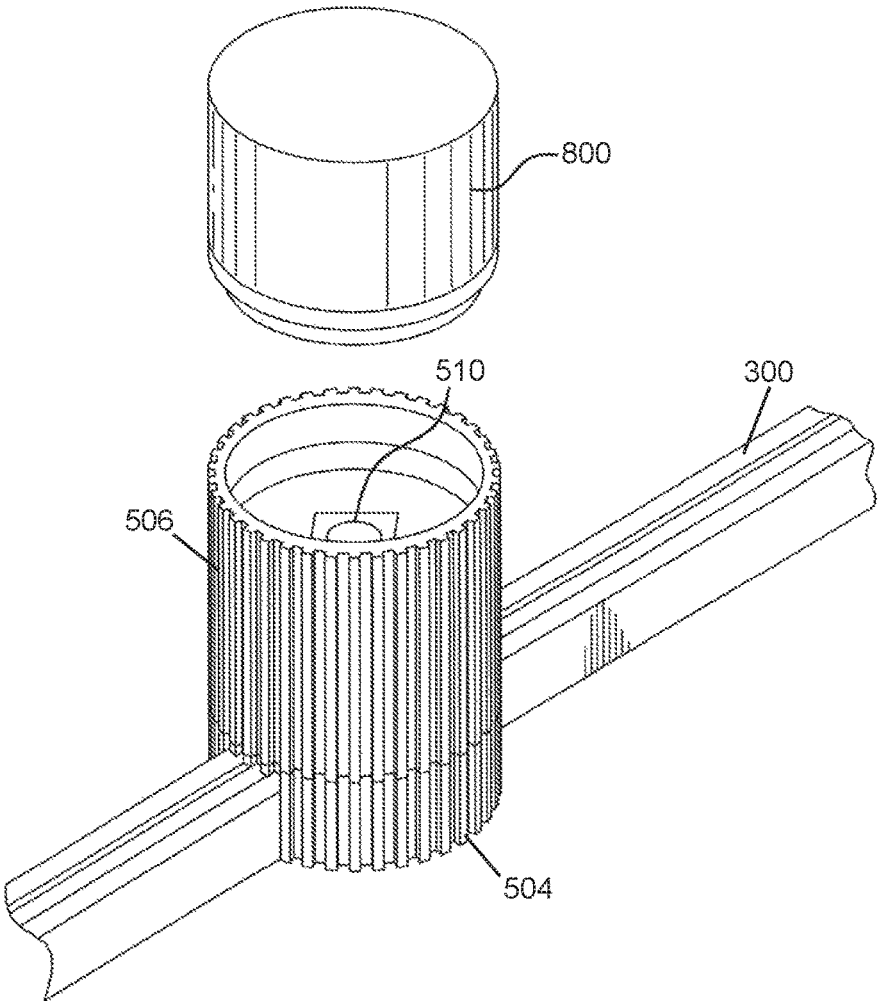
FIGS. 8A and 8B are various views showing features of another embodiment of a spot light of the present invention that is configured to be mountable directly on a power bar.
Figure 8B:
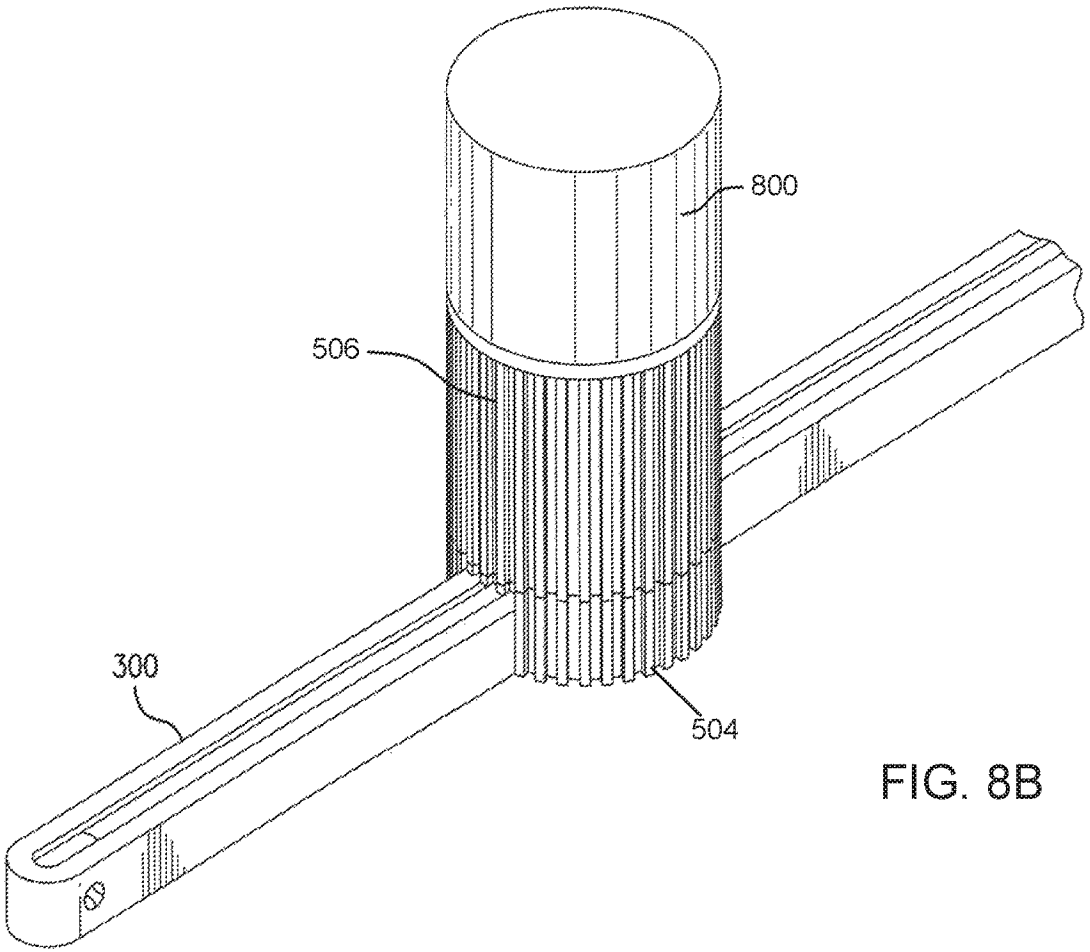

In FIGS. 8A and 8B, a cylindrical diffuser 800 is used instead of a cover such as the cover 600 of FIGS. 7A and 7B.

Figure 9A:
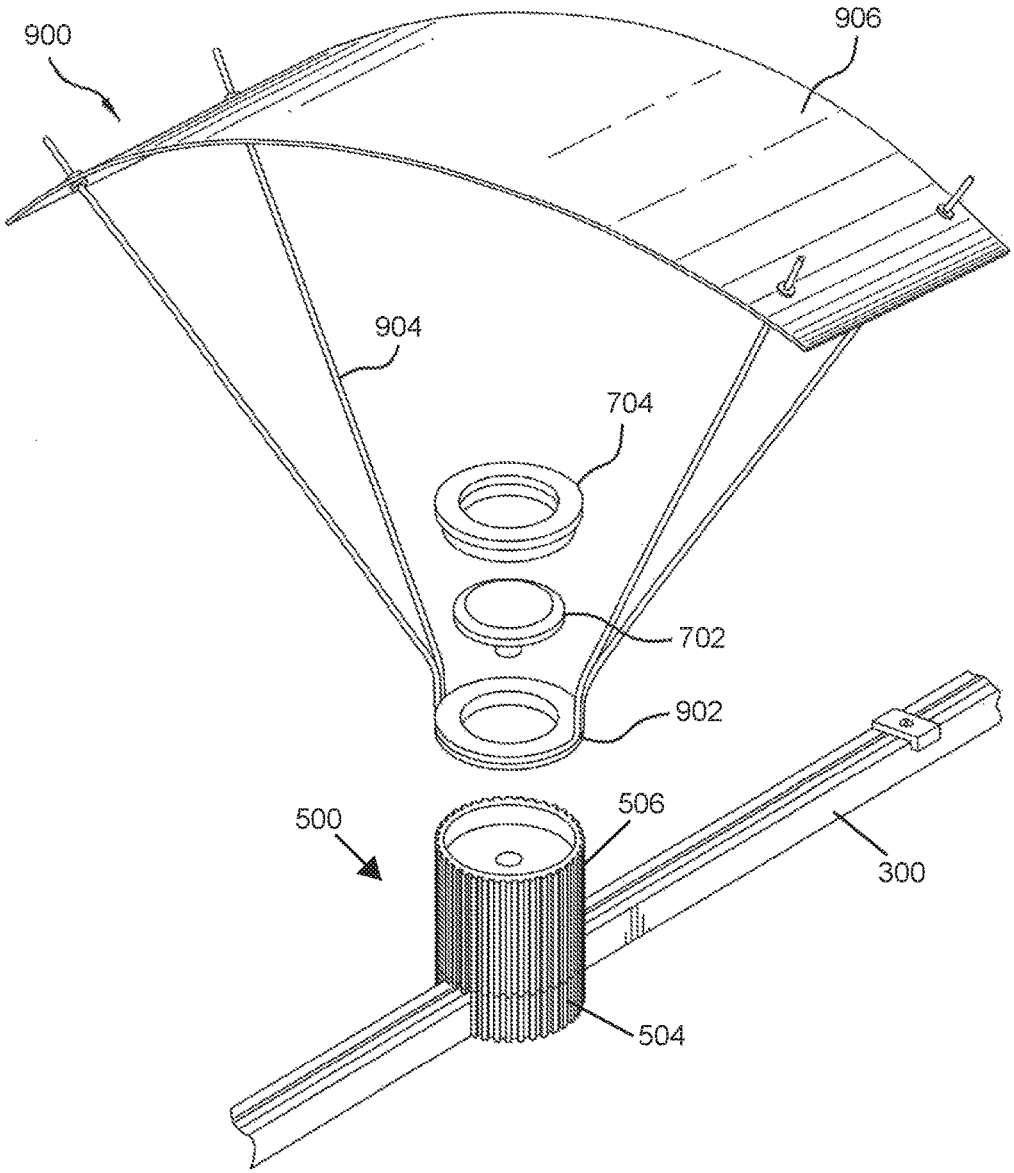
FIGS. 9A-9C are various views of an embodiment of a pendant configured for selective rotation about a horizontal and/or vertical axes.
Figure 9B:
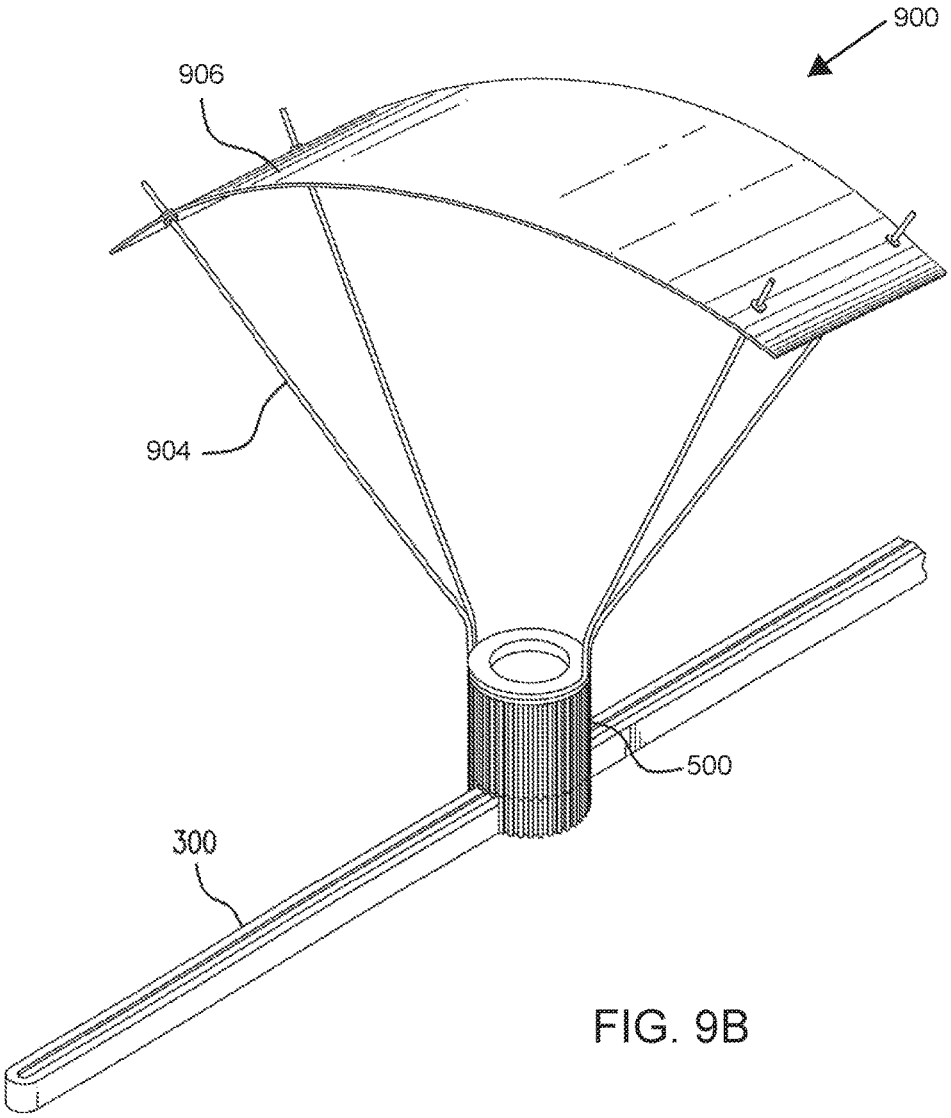

As shown in FIGS. 9A and 9B a parachute shaped pendant 900 is mountable to a spot light, such as the spot light 500. The pendant 900 includes a support member 902 that is attachable to the head 506 of the spot light 500 and includes four or more wires 904 that extend therefrom to hold a translucent sheet 906. The lens 702 is mounted on the spot light 500 and secured to the spot light 500 by a ring 910. The ring 910 attaches to the head 506 of the spot light (by a threaded engagement or other conventional means).

Figure 9C:
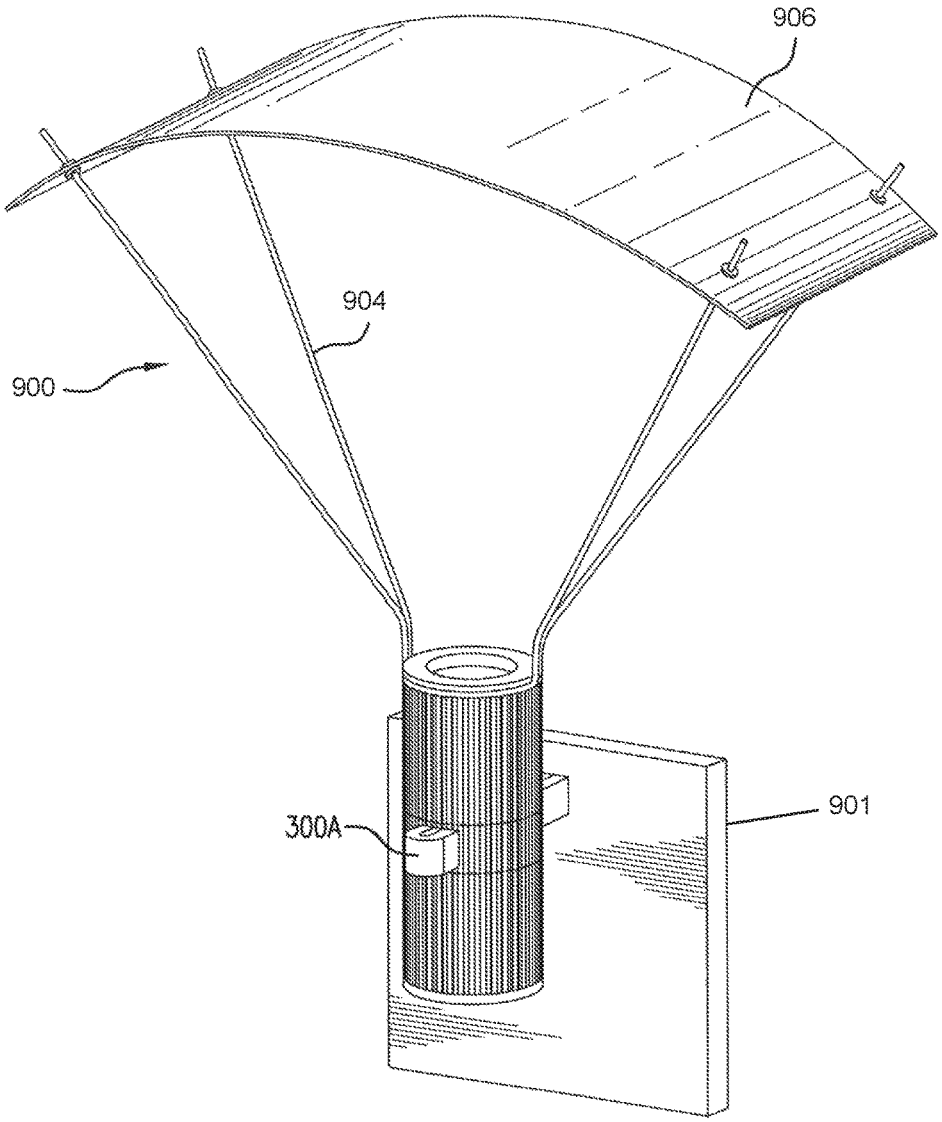

As shown in FIG. 9C, the pendant 900 is mounted to the double headed spot light 600 of FIGS. 6A-6C, which is in turn mounted to a wall 601 via a short power bar 300A to form a sconce.

FIGS. 10A-10E show details of a directional spot pendant 1000. The pendant 1000 is supported by two rods 1002, 1004 and includes a cylindrical housing 1006, a lens (or a diffuser) 1008 and a mounting ring 1010.

Figure 10A:
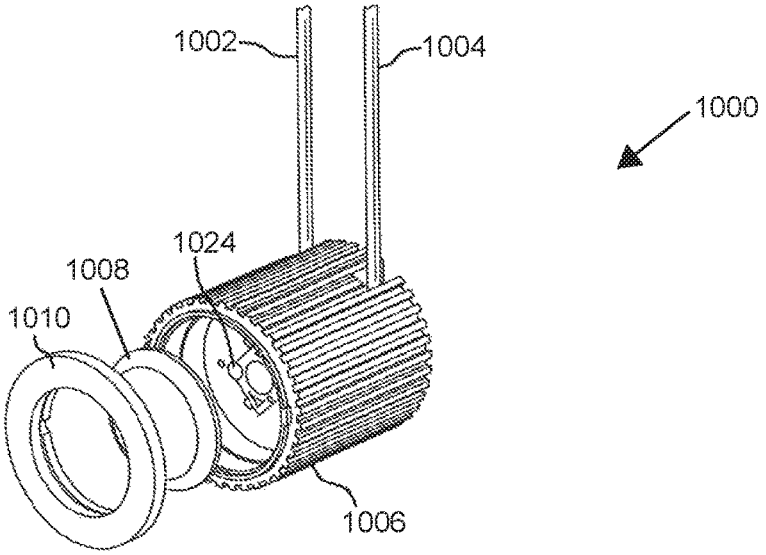
FIGS. 10A-10E are assembly views of another embodiment of a pendant configured for attachment to a power bar.
Figure 10B:
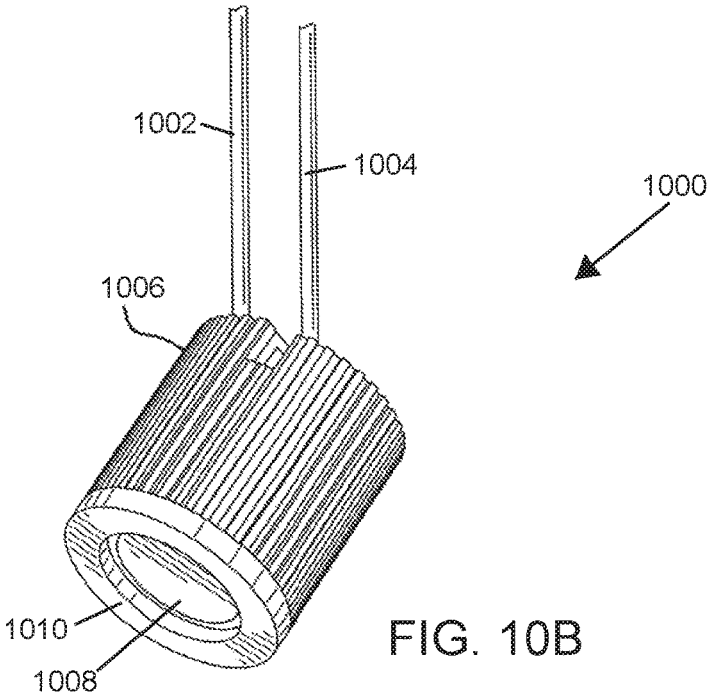
Figure 10C:
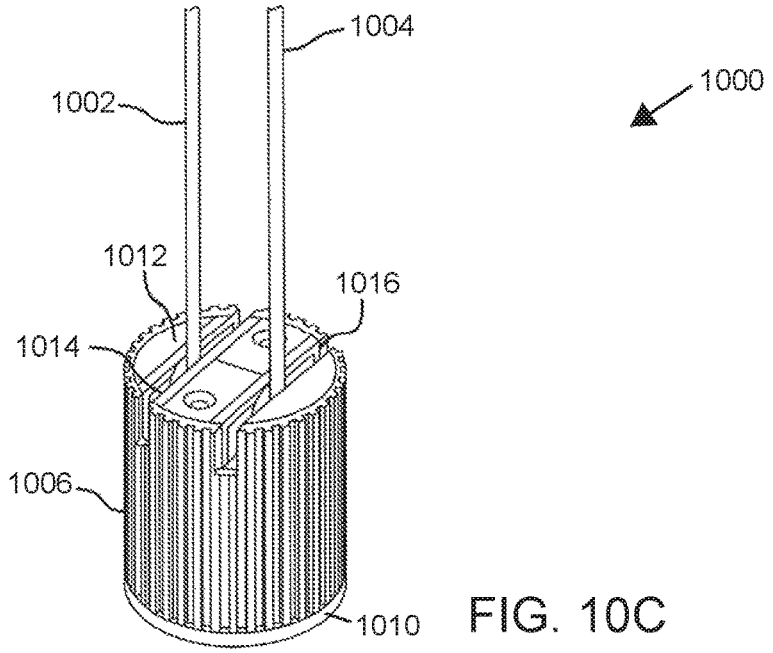
Figure 10D:
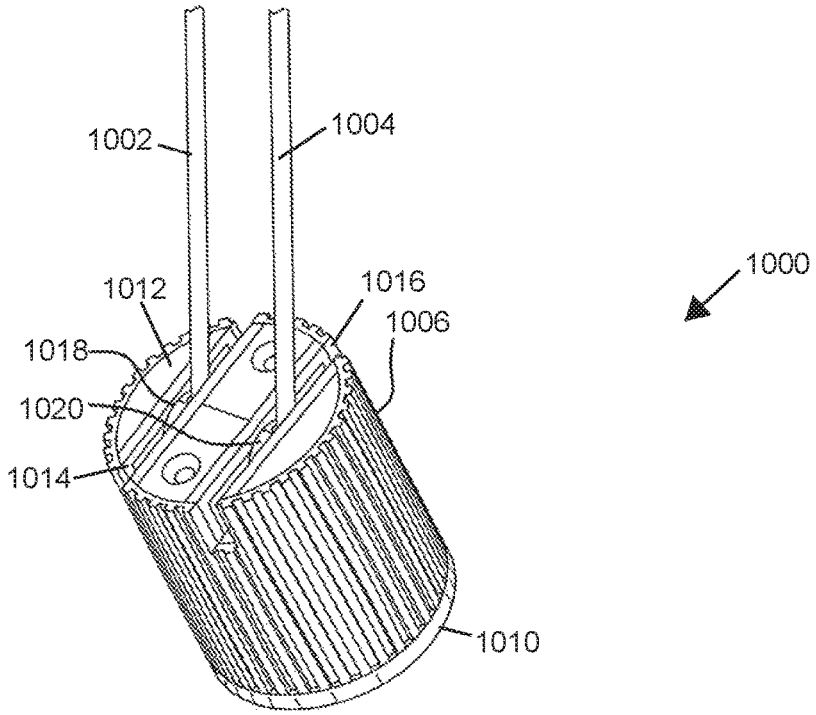
Figure 10E:
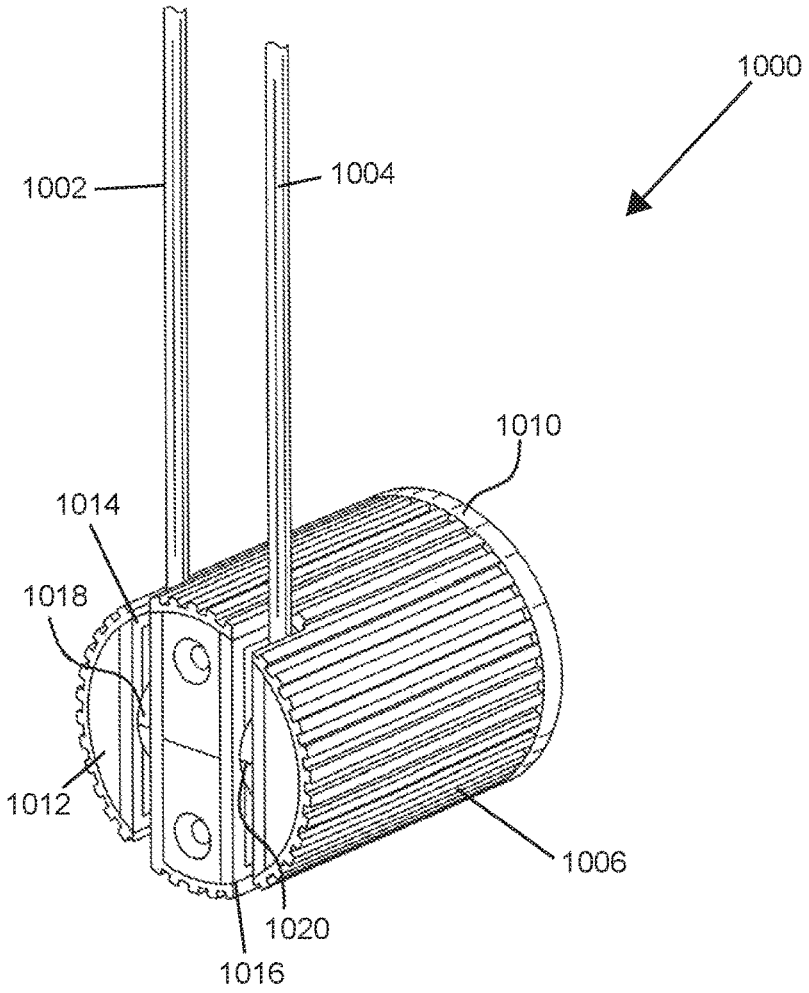

As illustrated in FIGS. 10C-10E, the housing 1006 has a top circular surface 1012 with two parallel channels 1014, 1016. Disposed within each channel 1014, 1016 is a semicircular connector 1018, 1020, respectively. These connectors 1018, 1020 have two orifices (not shown) that are configured to receive the lower ends of the rods 1002, 1004, respectively. The connectors 1018, 1020 are rotatable about a horizontal axis allowing the housing 1006 to rotate up to 180° as seen in FIGS. 10A-10E. The connectors 1018, 1020 are also adapted to provide an electric current path from the rods 1002, 1004 to a power circuit disposed inside the housing 1006 and drive one or more LEDs 1024 (see FIG. 10A) or other light sources within the housing 1006.

Figure 11A:
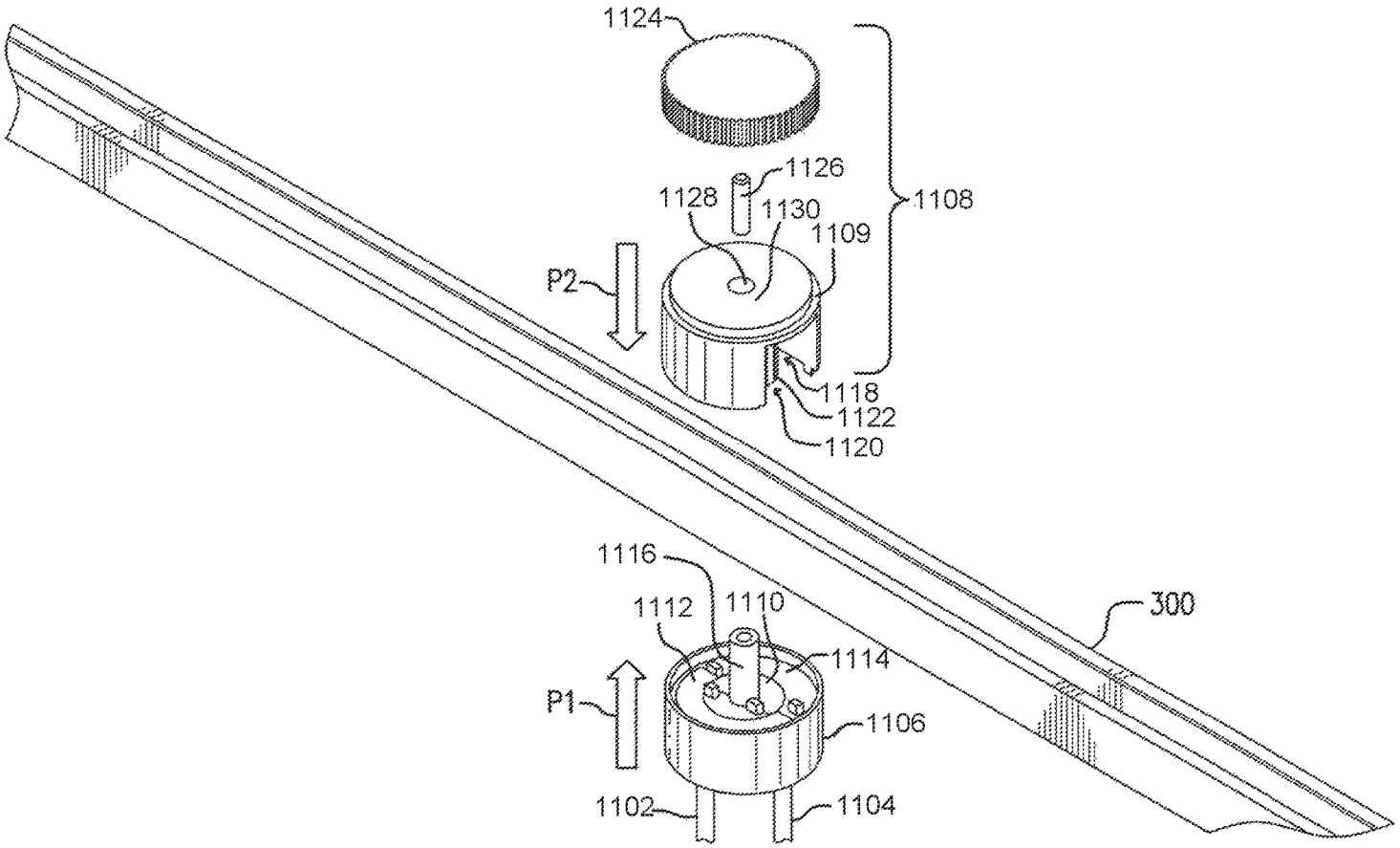
FIGS. 11A and 11B are perspective assembly views of a mounting member that is configured to be mounted to a power bar and selectively rotate rods about a vertical axis according to an exemplary embodiment of the present invention.
Figure 11B:
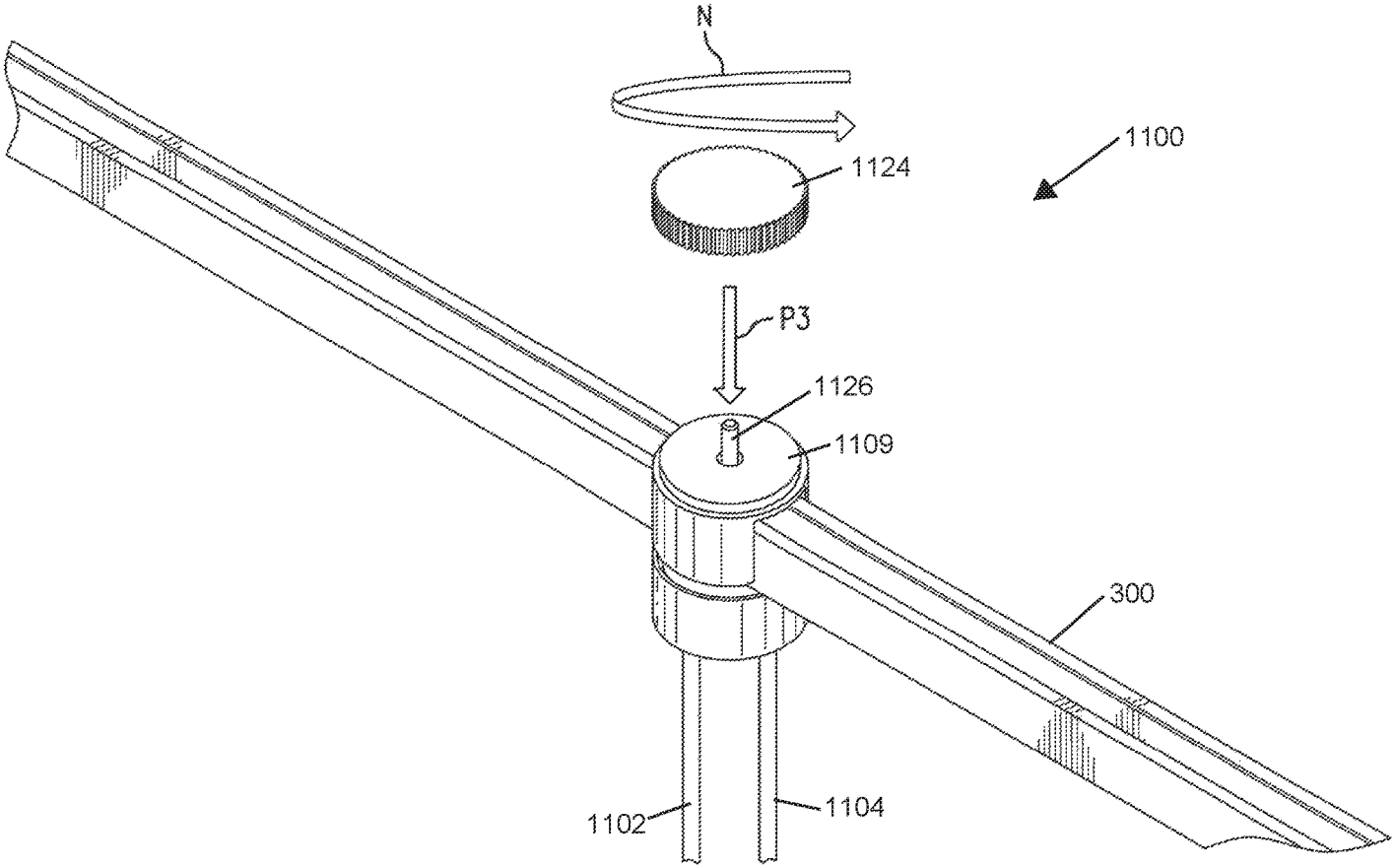

Referring now to FIGS. 11A and 11B, in one embodiment, a mounting member 1100 is provided for selectively rotating two vertical rods 1102, 1104, about a vertical axis while being mounted on a power bar, such as the generic power bar 300. The mounting member 1100 includes a lower housing 1106, an upper assembly 1108.

The lower housing 1106 includes a top surface 1110 with two arcuate conducting surfaces 1112, 1114 that are each electrically connected to the rods 1102, 1104, respectively. Rising vertically above the top surface 1110 is a hollow shaft 1116.

The upper assembly 1108, similar to the center hub 504 in FIG. 5A, includes a housing 1109 that has two horizontal channels 1118, 1120 that are separated by a central wall 1122, and a disk portion 1124. An axle 1126 fits through a hole 1128 in an intermediate surface 1130 and is mechanically fixed to the disk portion 1124. The lower portion 1106 and the upper portion 1108 can be snapped together by pushing them toward each other as indicated by arrows P1, P2 in FIG. 11A. An interference fit is formed between the lower and upper portions 1106, 1108 with the power bar 300 being disposed in the channels 1118, 1120 and the center wall 1122 engaging the rails 302, 304 of the power bar 300. In this position, electrical clips (not shown) on the center wall 1122 connect the conducting surfaces 1112, 1114 with the rails 302, 304 within the power bar 300. As the disk 1124 is snapped onto the housing 1109 and the disk 1124 is pushed downward in direction P3, the axle 1126 passes through the hole 1128 and engages the shaft 1116 of the lower portion 1106. Therefore, when the disk 1124 is rotated about its vertical axis defined by the axle 1128 and the shaft 1116, the motion is transmitted to the rods 1102, 1104 thereby rotating the rods 1102, 1104 as indicated by arrow N. In other words, rotating the disk 1124 causes the rods 1102, 1104 to rotate by up to 180°. A pendant (not shown) can be attached to the rods 1102, 1104 and rotated as well.

Going back to FIG. 10C, if the pendant 1000 is attached to the rods 1002, 1004 that can be rotated about a vertical axis as described, then the pendant 1000 can be rotated not only about a horizontal axis, but also about a vertical axis and, thus, can be positioned to point at any downward direction. An interference fit is provided for both the connectors 1018, 1020 and within the mounting member 1100 so that once the pendant is positioned to point at any particular direction, it will be maintained in that position by the frictional forces from these interference fits.

Numerous modifications may be made to this invention without departing from its scope as defined in the appended claims.

What is claimed is:

1. A pendant of a modular lighting system that includes a power bar, which has a first rail and a second rail that is horizontally spaced from the first rail and receives power from a power source, the pendant comprising:

a center hub having first surface, a second surface that is spaced from the first surface, a channel extending from the second surface toward the first surface and delimited by a first internal wall and a second internal wall that is spaced from the first internal wall and electrical clips arranged within the channel, the channel configured to extend over the first rail and the second rail of the power bar with the electrical clips configured to form an interference fit and an electrical connection with the first rail and the second rail of the power bar;

a pendant body attached to said first surface of the center hub; and a light source arranged within the pendant body, receiving power through said electrical clips and generating light.

2. The pendant of claim 1, further comprising two pins extending from the first surface of the center hub and two openings in the pendant body with the pendant body attached to the center hub by coupling said pendant body and said center hub by arranging said pins into the openings and twisting said pendant body and said center hub in opposite directions with respect to each other.

3. The pendant of claim 2, wherein said pins provide electrical current to said light source.

4. The pendant of claim 2, wherein the openings of the pendant body are arcuate.

5. The pendant of claim 1, wherein the center hub and said pendant body have matching cross-sections.

6. The pendant of claim 5, wherein the center hub and said pendant body are cylindrical.

7. The pendant of claim 1, further comprising a cover configured to contact a side of the power bar opposite the electrical clips of the center hub and be attached to the center hub to secure the center hub to the power bar and concealing the channel of the center hub.

8. The pendant of claim 7, further comprising a second pendant body that is substantially identical to said first pendant body and that is configured to be attachable to the a side of the cover opposite that of the pendant body.

9. The pendant of claim 1, wherein the center hub includes a first tab that has hole extending therethrough and a second tab that is spaced from the first tab that has a second hole extending therethrough and the cover includes a first opening extending therethrough and a second opening extending therethrough that is spaced from the first opening that are configured to be aligned with the first hole and the second hole of the first tab and the second tab, respectively.

10. The pendant of claim 9, wherein a first fastener extends through the first hole and the first tab and a second fastener extends through the second hole and the second tab to fix the cover to the center hub.

11. The pendant of claim 1, further comprising a cover assembly that includes a lens that is mountable to the pendant body to disperse light from the light source and a ring to secure the lens to the pendant body.

12. The pendant of claim 1, further comprising a support member that is mountable to the pendant body and a covering spaced from the cover assembly.

13. The pendant of claim 1, further comprising a diffuser that is mountable to the pendant body to disperse light from the light source.

14. A pendant of a modular lighting system having a power bar that includes a first rail and a second rail that is horizontally spaced from the first rail and receives power from a power source and a hanger having a power bar engaging member selectively engaging the power bar and two vertical rods with each of the rods being electrically connected to a respective one of the first rail and the second rail, the pendant comprising:

a pendant body including a first surface and a second surface that is spaced from the first surface, a first channel extending from the first surface toward the second surface and a second channel that is spaced from the first channel, extending from the first surface toward the second surface, a first connector disposed in the first channel and a second connector disposed in the second channel, each of said first connector and said second connector being configured to receive a respective end of one of said rods and a light source disposed in said pendant body and generating light when receiving current from the power bar through the rods and said first connector and said second connector configured to rotate within the first channel and the second channel, respectively, to allow said pendant body to rotate about a horizontal axis with respect to the rods while remaining connected to the rods.

15. The pendant of claim 14, wherein the first channel and the second channel are parallel to each other.

16. The pendant of claim 14, wherein the first channel and the second channel are sized to receive a portion of the rods when said pendant body is disposed at an angle of about plus or minus 90°.

17. The pendant of claim 14, further comprising a lens arranged within an opening in the second surface, covering the light source.

18. A modular lighting system having a power bar that includes a first rail and a second rail that is horizontally spaced from the first rail and receives power from a power source, the modular lighting system comprising:

an assembly including a first housing having a first surface, a second surface, a first channel extending from the second surface toward the first surface, a second channel that is spaced from the first channel extending from the second surface toward the first surface, a central wall extending from the housing toward the second surface, separating the first channel and the second channel, the first channel and the second channel configured to extend over the first rail and the second rail of the power bar with the central channel extending between and engaging the first rail and the second rail of the power bar; and a second housing including a first surface having a shaft extending therefrom and a second surface having a first rod and a second rod extending therefrom, the rod configured to extend between the first rail and the second rail of the power bar and be contactable with the first housing.

19. The pendant of claim 18, further comprising a disk configured to be attached to the axle and rotatable to move the first rod and the second rod about a vertical axis with respect to the power bar.

20. The modular lighting system of claim 18, further comprising a hole in the first surface of the first housing and an axle configured to be arranged in the hole and engage the shaft of the second housing.

21. The modular lighting system of claim 18, wherein the second housing includes a first conducting surface and a second conductive surface arranged on the first surface thereof.

* * * * *